US012188140B2

(12) United States Patent
Jastrzebski

(10) Patent No.: US 12,188,140 B2
(45) Date of Patent: Jan. 7, 2025

(54) ELECTROREFINING APPARATUS AND PROCESS FOR REFINING LITHIUM METAL

(71) Applicant: Li-Metal Corp., Markham (CA)

(72) Inventor: Maciej Jastrzebski, Markham (CA)

(73) Assignee: Arcadium Lithium Intermediate IRL Limited, Shannon (IE)

( * ) Notice: Subject to any disclaimer, the term of this patent is extended or adjusted under 35 U.S.C. 154(b) by 0 days.

(21) Appl. No.: 18/067,780

(22) Filed: Dec. 19, 2022

(65) Prior Publication Data

US 2023/0167565 A1 Jun. 1, 2023

Related U.S. Application Data

(63) Continuation of application No. PCT/CA2022/050092, filed on Jan. 21, 2022.

(Continued)

(51) Int. Cl.

| | |
|---|---|
| ***C25C 3/02*** | (2006.01) |
| ***C25C 7/00*** | (2006.01) |
| ***C25C 7/02*** | (2006.01) |

(52) U.S. Cl.

CPC ..... *C25C 3/02* (2013.01); *C25C 7/005* (2013.01); *C25C 7/025* (2013.01)

(58) Field of Classification Search

CPC ..... C25C 3/02

(Continued)

(56) References Cited

U.S. PATENT DOCUMENTS

| | | | |
|---|---|---|---|
| 1,501,756 | A | 7/1924 | Downs |
| 2,924,558 | A | 2/1960 | Gallinger |

(Continued)

FOREIGN PATENT DOCUMENTS

| | | |
|---|---|---|
| CA | 2242421 | 8/1997 |
| CA | 3010198 A1 | 7/2017 |

(Continued)

OTHER PUBLICATIONS

Sridharan et al, Thermal Properties of LiCI-KCI Molten Salt for Nuclear Waste Separation, OSTI.gov Technical Report, available online at https://www.osti.gov/biblio/1058922, Nov. 2012, pp. 1-111 (Year: 2012).*

(Continued)

*Primary Examiner* — Harry D Wilkins, III

(74) *Attorney, Agent, or Firm* — Williams Mullen; F. Michael Sajovec

(57) ABSTRACT

An electrorefining process for refining relatively purer lithium metal from a lithium-alloy feedstock material using a three-layer electrorefining apparatus can include a) providing an anode layer comprising a molten, lithium-alloy feedstock material that includes a combination of lithium metal having a first purity and a carrier material; b) providing an electrolyte layer comprising a molten salt electrolyte material; c) providing a product layer comprising molten lithium metal having a second purity that is greater than the first purity above the electrolyte layer; and d) applying an activation electric potential that is sufficient to electrolyze the lithium-alloy feedstock material between an anode layer and the product layer that is electrically isolated from the anode layer, whereby lithium metal is liberated from the lithium-alloy feedstock material, migrates through the electrolyte layer and collects in the product layer.

10 Claims, 15 Drawing Sheets

Related U.S. Application Data

(60) Provisional application No. 63/140,127, filed on Jan. 21, 2021, provisional application No. 63/140,119, filed on Jan. 21, 2021.

(58) Field of Classification Search
USPC ..... 205/407
See application file for complete search history.

(56) References Cited

U.S. PATENT DOCUMENTS

| | | | | |
|---|---|---|---|---|
| 3,111,745 | A | 11/1963 | Carlisle | |
| 3,408,282 | A | 10/1968 | Frank | |
| 3,607,684 | A | 9/1971 | Kuhn | |
| 3,962,064 | A * | 6/1976 | Brut | C25C 7/005 205/407 |
| 4,089,770 | A | 5/1978 | Lemke | |
| 4,092,228 | A | 5/1978 | Ross | |
| 4,108,743 | A | 8/1978 | Minck | |
| 4,156,635 | A | 5/1979 | Cooper | |
| 4,186,049 | A | 1/1980 | Blum | |
| 4,256,551 | A * | 3/1981 | Cliff | C25B 1/00 205/531 |
| 4,455,202 | A * | 6/1984 | Sintim-Damoa | C25C 3/02 205/407 |
| 4,592,821 | A | 6/1986 | Keinborg | |
| 4,617,098 | A | 10/1986 | Verdier | |
| 4,740,279 | A * | 4/1988 | Muller | C25C 3/02 204/247 |
| 4,780,186 | A | 10/1988 | Christini | |
| 4,790,917 | A * | 12/1988 | Dewing | C25C 3/02 205/705 |
| 4,849,072 | A * | 7/1989 | Bowman | C25C 3/02 205/407 |
| 4,882,017 | A | 11/1989 | Weaver | |
| 4,973,390 | A * | 11/1990 | Christini | C25C 7/005 204/279 |
| 4,988,417 | A | 1/1991 | DeYoung | |
| 5,131,988 | A * | 7/1992 | Peterson | C01D 15/04 75/690 |
| 5,650,053 | A | 7/1997 | Gay | |
| 5,951,843 | A | 9/1999 | Itoh | |
| 6,063,247 | A | 5/2000 | Bergmann | |
| 6,086,733 | A | 7/2000 | Carey | |
| 6,368,486 | B1 * | 4/2002 | Thompson | C25C 7/02 205/406 |
| 6,368,487 | B1 | 4/2002 | Huber | |
| 6,730,210 | B2 | 5/2004 | Thompson | |
| 7,897,023 | B2 | 3/2011 | Bakhir | |
| 8,715,482 | B2 | 5/2014 | Amendola et al. | |
| 11,174,562 | B2 | 11/2021 | But | |
| 2003/0094379 | A1 | 5/2003 | Jacobson | |
| 2004/0111874 | A1 * | 6/2004 | Schierle-Arndt | C25C 3/02 252/62.2 |
| 2004/0194574 | A1 | 10/2004 | Cardarelli | |
| 2005/0100793 | A1 | 5/2005 | Jonghe | |
| 2006/0144701 | A1 | 7/2006 | Kelly | |
| 2007/0246368 | A1 * | 10/2007 | Huber | C25C 7/04 205/59 |
| 2008/0054629 | A1 | 3/2008 | Sawanura | |
| 2010/0084265 | A1 | 4/2010 | Lee | |
| 2011/0135565 | A1 | 6/2011 | Bingham | |
| 2012/0006690 | A1 * | 1/2012 | Amendola | C25C 7/08 205/407 |
| 2012/0241314 | A1 | 9/2012 | Madono | |
| 2013/0001097 | A1 | 1/2013 | Nakamura | |
| 2014/0131217 | A1 | 5/2014 | Buschmann | |
| 2015/0014184 | A1 | 1/2015 | Swonger | |
| 2015/0041311 | A1 | 2/2015 | Mathé | |
| 2015/0064568 | A1 | 3/2015 | Yushin | |
| 2015/0129432 | A1 | 5/2015 | Wright | |
| 2015/0211135 | A1 | 7/2015 | Fan | |
| 2016/0251764 | A1 | 9/2016 | Iltsenko | |
| 2018/0187317 | A1 | 7/2018 | Gordon | |
| 2019/0048483 | A1 * | 2/2019 | Swonger | C25C 1/02 |
| 2020/0181783 | A1 | 6/2020 | But | |
| 2020/0399772 | A1 | 12/2020 | Kiggins | |
| 2022/0267918 | A1 | 8/2022 | Jastrzebski | |
| 2023/0119799 | A1 | 4/2023 | Jastrzebski | |
| 2023/0167565 | A1 | 6/2023 | Jastrzebski | |
| 2023/0183875 | A1 | 6/2023 | Jastrzebski | |
| 2023/0203689 | A1 | 6/2023 | Jastrzebski | |
| 2023/0349061 | A1 | 11/2023 | Jastrzebski | |

FOREIGN PATENT DOCUMENTS

| | | |
|---|---|---|
| CN | 101356668 | 1/2009 |
| GB | 1024689 | 3/1966 |
| RU | 2008105197 | 8/2009 |
| WO | 1993010281 | 5/1993 |
| WO | 2014152393 A1 | 9/2014 |
| WO | 2019219821 | 11/2019 |
| WO | 2021012055 | 1/2021 |

OTHER PUBLICATIONS

Sekiguchi et al, Thermodynamic analysis of molten alkali halide mixtures by molecular dynamic simulations, Journal of Molecular Liquids, vol. 315, Oct. 2020, 113758 pp. 1-7 (Year: 2020).*

The International Search Report and Written Opinion dated May 3, 2022 for PCT/CA2022/050092.

The International Search Report and Written Opinion dated Apr. 14, 2022 for PCT/CA2022/050095.

The International Search Report and Written Opinion dated Apr. 21, 2022 for PCT/CA2022/050093.

Lessing, Paul, A review of sealing technologies applicable to solid oxide electrolysis cells, Journal of Materials Science, vol. 42, No. 10, Jan. 2007, pp. 3465-3476 (Year: 2007).

Office action issued by CIPO on Dec. 11, 2023 in relation to CA 3,183,962.

European Search Report issued Jan. 4, 2024 in respect of EP 40004260.

Xin Zhang, Aiguo Han and Yongan Yang, "Review on the production of high-purity lithium metal", J. Mater. Chem. A, 2020,8, 22455-22466.

William H. Kruesi et al., "The Electrowinning of Lithium from Chloride-Carbonate Melts", Metallurgical Transactions B, vol. 24B, Aug. 1993-605.

Lukasko J.J and Muprhy J. E., "Electrolytic Production of Calcium Metal", Report of Investigations/ 1990.

Office Action issued on CA 183,962 on Jan. 25, 2023.

Office action issued onCA 3,183,962 on Dec. 11, 2023.

International search report written opinion for international application No. PCt/CA2020/051021 mailed Oct. 5, 2020.

Office action issued in CN202080053142 on Apr. 7, 2024.

European Search Report issued Jan. 4, 2024 in relation to EP 2084442.2.

International Search Report PCT/CA2020/051021 dated Sep. 8, 2020.

European Search Report issued for EP application No. 20844442.2, mailed Dec. 8, 2023.

* cited by examiner

ELECTROREFINING APPARATUS AND PROCESS FOR REFINING LITHIUM METAL

CROSS-REFERENCE TO RELATED APPLICATIONS

This application is a continuation of co-pending international patent application no. PCT/CA2022/050092, filed Jan. 21, 2022 and entitled ELECTROREFINING APPARATUS AND PROCESS FOR REFINING LITHIUM METAL, which itself claims the benefit of and priority to U.S. provisional application No. 63/140,127 filed Jan. 21, 2021 and entitled Electrorefining Cell for Lithium Metal, and U.S. provisional application No. 63/140,119 filed Jan. 21, 2021 and entitled Process for Production Refined Lithium Metal, the entirety of these applications being incorporated herein by reference.

FIELD OF THE INVENTION

In one of its aspects, the present invention relates to refining lithium metal from a lithium-rich feedstock alloy, and in particular an electrorefining cell that can be used for refining lithium metal.

INTRODUCTION

U.S. Pat. No. 4,156,635 discloses a method for recovering lithium from its molten amalgam by electrolysis of the amalgam in an electrolytic cell containing as a molten electrolyte a fused-salt consisting essentially of a mixture of two or more alkali metal halides, preferably alkali metal halides selected from lithium iodide, lithium chloride, potassium iodide and potassium chloride. A particularly suitable molten electrolyte is a fused-salt consisting essentially of a mixture of at least three components obtained by modifying an eutectic mixture of LiI—KI by the addition of a minor amount of one or more alkali metal halides. The lithium-amalgam fused-salt cell may be used in an electrolytic system for recovering lithium from an aqueous solution of a lithium compound, wherein electrolysis of the aqueous solution in an aqueous cell in the presence of a mercury cathode produces a lithium amalgam. The present method is particularly useful for the regeneration of lithium from the aqueous reaction products of a lithium-water-air battery.

U.S. Pat. No. 6,730,210 discloses a low temperature alkali metal electrolysis process is provided. The process comprises carrying out the electrolysis in the presence of a co-electrolyte and an alkali metal halide. The co-electrolyte comprises (1) a nitrogen-containing compound and optionally one or more Group IB halides, Group IIIA halides, Group VIII halides; (2) a Group IIIA halide, a Group VB halide, or combinations of a Group IIIA halide and a Group VB halide; or (3) water. Also provided is a low temperature electrolysis process, which comprises carrying out the process using a cathode that comprises (1) a liquid alkali metal; (2) an alloy of two or more metals selected from the group consisting of bismuth, lead, tin, antimony, indium, gallium, thallium, and cadmium; or (3) an electrically conductive liquid solvated alkali metal. Further provided is an electrolyte comprising an alkali metal halide and a co-electrolyte that comprises (1) a nitrogen-containing compound and optionally one or more Group IB halides, Group IIIA halides, Group VIII halides or (2) a Group IIIA halide, a Group VB halide, or combinations of a Group IIIA halide and a Group VB halide.

International patent publication no. WO2019/219821 discloses a process for copper production comprising the electrorefining of copper in an electrolytic cell, wherein the voltage difference over the cell is maintained at less than 1.6 volt, the anode comprises at most 98.0% wt of copper and less than 1.00% wt of iron, the current density through the cell is at least 180 A/m$^2$ of cathode surface, electrolyte is removed from the cell during the operation at an average refreshing rate of 30-1900% per hour, by overflow of a first stream of electrolyte over a cell wall, and a gas is introduced into the cell and bubbled through the electrolyte in between anode and cathode. Further disclosed is a liquid molten metal composition suitable for copper anode electrorefining comprising at least 90.10% wt and at most 97% wt of copper, at least 0.1% wt of nickel, at least 0.0001% wt and less than 1.00% wt of iron, and 250-3000 ppm wt of oxygen.

U.S. Pat. No. 5,650,053 discloses a cathode-anode arrangement for use in an electrolytic cell is adapted for electrochemically refining spent nuclear fuel from a nuclear reactor and recovering purified uranium for further treatment and possible recycling as a fresh blanket or core fuel in a nuclear reactor. The arrangement includes a plurality of inner anodic dissolution baskets that are each attached to a respective support rod, are submerged in a molten lithium halide salt, and are rotationally displaced. An inner hollow cylindrical-shaped cathode is concentrically disposed about the inner anodic dissolution baskets. Concentrically disposed about the inner cathode in a spaced manner are a plurality of outer anodic dissolution baskets, while an outer hollow cylindrical-shaped is disposed about the outer anodic dissolution baskets. Uranium is transported from the anode baskets and deposited in a uniform cylindrical shape on the inner and outer cathode cylinders by rotating the anode baskets within the molten lithium halide salt. Scrapers located on each anode basket abrade and remove the spent fuel deposits on the surfaces of the inner and outer cathode cylinders, with the spent fuel falling to the bottom of the cell for removal. Cell resistance is reduced and uranium deposition rate enhanced by increasing the electrode area and reducing the anode-cathode spacing. Collection efficiency is enhanced by trapping and recovery of uranium dendrites scrapped off of the cylindrical cathodes which may be greater in number than two.

US patent publication no. US2010/0084265 discloses a continuous electrorefining device for recovering metal uranium. The electrorefining device comprises an electrolytic cell having an internal accommodating space filled with electrolyte; a cathode unit including a top plate, connecting rods whose top ends are joined to the top plate, and cathode electrodes whose top end is joined to lower plates; an anode unit which is placed in a cylinder shape surrounding the cathode electrodes; a uranium recovery unit for drawing out the uranium metal by a first drawing-out means; and a transition metal recovery unit for drawing out the metal particles by a second drawing-out means. The cathode unit further comprises an insulating and vibration absorbing member that is interposed between the top plate and the cover plate; and a vibration means which is mounted on the top plate to transmit vibration and impact force to the cathode electrode through the connecting rods.

SUMMARY

Lithium metal can be produced using a variety of apparatuses and techniques, including molten salt electrolysis and electrolyzers can be used in the production of metals from chloride, oxide, nitrate, sulfate, or carbonate compounds. One suitable molten salt electrolyzer apparatus and method is described international patent application no. PCT/CA2020/051021, which describes a containment vessel that is configured to contain a molten salt anolyte (and function as an anolyte chamber) and to have at least one electrode assembly and preferably having at least two electrode assemblies (each having an anode and a complimentary cathode) positioned within the containment vessel. Optionally, a single containment vessel (preferably with a single anolyte bath) may have 2 or more electrode assemblies (electrode pairs), and may have at least 3, 4, 5, 6, 7, 8, 9, 10, 11, 12, 13, 14, 15 or more electrode assemblies. In some preferred embodiments the containment vessel may include at least 10 electrode assemblies.

Lithium metal produced via molten salt electrolysis, such as by using the apparatus described in international patent application no. PCT/CA2020/051021 or other suitable apparatuses, may have purities of approximately 95 and 99.8% (or higher or lower) depending on the particulars of the molten salt electrolysis, including its operating conditions, feedstock, post-processing processes and the like. As used herein, the lithium metal produced by such processes can be described as a crude lithium metal having a first purity that is lower than a desired or target, second purity that could be achieved by refining the crude lithium metal as described herein.

To help improve the purity of the lithium metal it may be desirable to refine the crude lithium metal. Some conventional processes for refining the crude lithium metal have included by molten settling, filtration, distillation and vacuum distillation. Some drawbacks of these processes can include low efficiency and efficacy, for example, producing product which remain contaminated by some undesirable species, and low recovery, producing a significant volume of waste material highly contaminated by impurities, as a by-product of the refining process.

Accordingly, there remains a need for an improved process for refining crude lithium metal into a refined lithium metal material that has a higher purity than the incoming crude lithium metal. Described herein are examples of improved processes and apparatuses for electrorefining lithium metal. In some examples, the new electrorefining apparatus includes a three-layer electrorefining cell that is configured to refine relatively purer lithium metal from an incoming feedstock that includes a lithium-rich feedstock alloy contains a combination of the crude lithium metal and a suitable base or carrier material that used to help carry/transport the crude lithium during the process and can serve as at least a portion of the consumable anode material that is converted to the desired refined lithium metal during the electrorefining processes described herein. The carrier material in the alloy is formed from one or more suitable carrier metals, and resulting lithium-rich feedstock alloy can therefore include the crude lithium metal and 1, 2, 3, 4 or more carrier metals. Some examples of suitable carrier metals that can be used as the carrier material in the feedstock alloy can include lead, bismuth, zinc, mercury, tin, aluminum, magnesium, indium, thallium, copper, iron or alloys of these metals and the like. The interior of the apparatus can be configured to contain three function layers, including i) a bottom allow layer including the lithium-rich feedstock alloy, ii) a molten salt electrolyte layer and iii) an upper refined metal layer.

Optionally, the metallic, lithium-rich feedstock alloy can be configured to serve as at least a portion of the anode assembly, in combination with an anode conductor member that can be connected to a suitable power source, in newly developed electrorefining apparatuses described herein. In this arrangement, the same feedstock alloy can function as both the anode as well as the source of lithium metal that is depleted during the electrorefining process.

The choice of the carrier materials in the feedstock alloy can influence some of the properties of the resulting lithium-rich feedstock alloy, including its melting point. It some instances, combining two or more carrier metals along with lithium in the alloy may result in a lithium-rich feedstock alloy that has a lower melting temperature than its constituent metals. Configuring the lithium-rich feedstock alloy to have a relatively lower melting point (as compared to some other possible alloy compositions) may allow the apparatuses described herein to operate a relatively lower operating temperatures than apparatuses using other alloys, and this may help reduce the overall energy consumption of the electrorefining apparatus and process.

The choice of the carrier materials in the feedstock alloy can influence the density and vapour pressure, and other characteristics, of the resulting lithium-rich feedstock alloy. Preferably, the density of the feedstock alloy is greater than the density of both the electrolyte material and the refined lithium metal, which can help facilitate and maintain the 3-layer structure that is intended to be provided within the electrorefining apparatus. Preferably, the vapour pressure of the carrier material should be lower than the vapour pressure of the refined lithium metal, and preferably can be at least 10 times lower than the vapour pressure of the lithium metal in the product layer.

The electrorefining apparatus may optionally be configured as a flow-through type of cell in which the incoming lithium-rich feedstock alloy is in a liquid (e.g. molten) state and is circulating and/or flowing through the interior of the electrorefining cell while it is in use. Such an apparatus can include a suitable lithium-rich feedstock alloy inlet to receive the incoming flow of lithium-rich feedstock, and an alloy outlet at another location through which the then lithium-depleted alloy material can be withdrawn from the electrorefining cell. The electrorefining cell may be configured in any suitable shape or configuration, with generally elongate, pipe- or conduit-like arrangements being preferred for at least some of the processes described herein. These elongate arrangements may be particularly well-suited to flow-through versions of the apparatus when arranged in a substantially horizontal manner, but may be oriented in other ways, including in a generally vertical manner which may be well suited to a non-flow through version of the apparatuses described herein.

Optionally, the flow-through electrorefining apparatus may also be configured so that the electrolyte material used within the cell is also flowing while the apparatus is in use. Such an apparatus can include a suitable electrolyte inlet and an electrolyte outlet at another location through which the electrolyte material can be withdrawn from the electrorefining cell.

Preferably, mixing between the layers of flowing feedstock alloy and flowing electrolyte material can be inhibited and/or minimized while the apparatus is in use. This may be done by ensuring the flowing liquids are substantially laminar and/or by including flow calming or directing devices or other flow or movement limiting features within the electrorefining cell. If layers of flowing feedstock alloy and flowing electrolyte material are both present, it is preferable that both layers are configured to flow in the same, or at least substantially the same direction as this may help reduce turbulence and/or mixing between the layers.

A suitable cathode can be provided within the electrorefining cell to allow for the application of the desired electric potential, and optionally may be in contact with the product layer and/or the electrolyte layer. The cathode may include some suitable type of refined metal collection apparatus, such as a hood, guide, conduit or the like that may help collect and/or direct the flow of the refined metal layer within the electrorefining cell, and may be in communication with the parts of a refined metal extraction system.

The levels of the incoming feedstock alloy, the liquid electrolyte layer (such as a molten salt) can be maintained at desired levels within the electrorefining cell using any suitable flow control apparatuses, including valves, pumps, weirs and the like.

The anode layer, and associated anode conductor member, and the cathode of the electrorefining cell can be part of or in contact with a common cell housing, and are to be electrically isolated from each other so that the required electric potential can be created. This can be done using a suitable isolating assembly that can be positioned between portions of the cell housing to provide electrical insulation. Optionally, the isolating assembly may also include one or more suitable sealing assemblies that can help fluidly seal the adjacent portions of the apparatus housing that are connected to each other. One example of a suitable seal assembly can be referred to as a freeze seal that includes a body portion that is cooled to a seal temperature that is lower than the freezing temperature of the electrolyte material it is in contact with so that a skin/layer of solidified, frozen electrolyte material (e.g. a layer of frozen, solidified salt) forms on the outer, sealing surface(s) of the body. This frozen salt layer can also help fill spaces/gaps between the body and any adjacent gaskets, flanges or other structures that are used at the connection between the housing portions, and may also help protect the body (and possibly other adjacent structures) from ongoing exposure to the molten salt electrolyte. Such a sealing assembly may also be considered as generally self-healing seal, as portions of the frozen salt layer that become damaged or break away from the body can be replaced by newly frozen salt material when the molten salt comes into contact with the cooled body.

A similar self-healing, freeze seal assembly can be provided at other locations in the cell and may be used to seal against other portions or other operating components. For example, a self-healing, freeze seal can be provided to help seal the location where the membrane extends through the outer walls/perimeter of the cell.

It may also be preferable in some examples of the cells described herein to at least substantially electrically isolate the housing portions as described herein. In such examples, the self-healing, freeze seals may be accompanied with electrically insulating, isolating flanges. This may useful in embodiments where the cooled body portion is formed from an electrically insulating material and/or by including one or more other suitable insulating gaskets, layers, seals and the like. Some examples of suitable insulating materials can include ceramic, alumina, Teflon®, mica, vermiculite, rubber and the like. To help protect these insulating materials from the molten salt within the cell they may also be at least partially coated with a layer of frozen salt that expands from the cooled surfaces of the body portion.

Referring to one broad aspect of the teachings described herein, a three-layer electrorefining apparatus for refining relatively purer lithium metal from a lithium-alloy feedstock material can include a housing defining an interior chamber that is at least partially bounded by a housing sidewall. The chamber can contain an anode layer including a molten, lithium-alloy feedstock material that includes a combination of lithium metal having a first purity and a carrier material that comprises at least one of bismuth, tin, aluminum, indium, thallium and alloys thereof. An electrolyte layer may be above the anode layer and may optionally include a molten salt electrolyte material that comprises at least one of LiCl—KCl, LII-KI and LiI—CsI. A product layer may be above the electrolyte layer and may include molten lithium metal having a second purity that is greater than the first purity. An anode conductor member is preferably connectable to a power source may be in contact with the lithium-alloy feedstock material in the anode layer. A cathode connectable to the power source may be, electrically isolated from the anode conductor member and, optionally may be in contact with the product layer. When an activation electric potential that is sufficient to electrolyze the lithium-alloy feedstock material is applied between the lithium-alloy feedstock material and the cathode lithium metal may be liberated from the lithium-alloy feedstock material, migrate through the electrolyte layer and collect in the product layer.

In accordance with one broad aspect of the teachings described herein, a three-layer electrorefining apparatus for refining relatively purer lithium metal from a lithium-alloy feedstock material may include a housing defining an interior chamber at least partially bounded by a housing sidewall. The chamber may contain an anode layer comprising a molten, lithium-alloy feedstock material that includes a combination lithium metal having a first purity and a carrier material; an electrolyte layer above the anode layer and comprising a molten salt electrolyte material; and a product layer above the electrolyte layer comprising molten lithium metal having a second purity that is greater than the first purity. An anode conductor member may be connectable to a power source and in contact with the lithium-alloy feedstock material in the anode layer. A cathode conducting member may be connectable to the power source, electrically isolated from the anode conductor member and in contact with the product layer. A seed of purer lithium metal, which is similar to the refined metals purity, is preferably introduced into product layer within the cell in contact with cathode conducting member. When an activation electric potential that is sufficient to electrolyze the lithium-alloy feedstock material is applied between the anode layer and the cathode lithium metal may be liberated from the lithium-alloy feedstock material, migrates through the electrolyte layer and collects in the product layer.

A refined metal extraction apparatus may be in fluid communication with the upper layer and configured to allow removal of the lithium metal from the product layer while the apparatus is in use.

The refined metal extraction apparatus may include a metal collector disposed within the chamber and in communication with the product layer and a metal extraction flowpath extending from the metal collector to outside the chamber.

The lithium-alloy feedstock material may have a density that is greater than a density of the electrolyte material and is greater than 1.6 g/cm3.

A vapour pressure of the carrier material may be at least 10 times lower than a vapour pressure of the lithium metal in the product layer.

The molten salt electrolyte material may have a density that is less than the density of lithium-alloy feedstock material and is greater than 0.6 g/cm3.

A concentration of the lithium metal in the lithium-alloy feedstock material may be equal to or less than about 80 wt %.

The concentration of the lithium metal in the lithium-alloy feedstock material may be equal to or greater than 0.1 wt %.

The carrier material comprises at least one of bismuth, tin, aluminum, indium, thallium, copper, iron and alloys thereof.

The carrier material may include at least two of bismuth, indium and tin.

The carrier material may include bismuth, indium and tin.

The concentration of bismuth within the carrier material may be between 0 wt %-80 wt %, and optionally between 30 wt %-60 wt %.

The concentration of indium metal within the carrier material may be between 0 wt %-80 wt %, and optionally between 22 wt %-60 wt %.

The concentration of tin within the carrier material may be between 0 wt %-80 wt %, and optionally between 10 wt %-60 wt %.

The lithium-alloy feedstock material may have a melting temperature that is between 200-800 deg. C.

The lithium-alloy feedstock material may have a melting temperature is less than 600 deg. C.

The second purity may be greater than 80 wt %, and may be greater than 99 wt %, and may be second purity is equal to or greater than 99.9 wt %, and may be equal to or greater than 99.995 wt %.

The anode conductor member may include a lower portion of housing sidewall.

The cathode may include an upper portion of the housing sidewall. A isolating assembly may be disposed between and fluidly seal and electrically isolate the lower portion of the housing sidewall from the upper portion of the housing sidewall.

The isolating assembly may include an isolating flange made from an electrically insulating material that is disposed between the lower portion of the housing sidewall from the upper portion of the housing sidewall and is exposed to at least the electrolyte layer.

The isolating flange may be made from a ceramic material.

The lower portion of the housing sidewall may include a lower mounting lip having a lower fastening aperture; the isolating flange includes a flange fastening aperture registered with the lower fastening aperture; and the upper portion of the housing sidewall includes a corresponding upper mounting lip having an upper fastening aperture registered with the flange fastening aperture. The isolating assembly may include an electrically isolating fastener extending through the lower, flange and upper fastening apertures to join the lower portion and the upper portion of the housing sidewall.

The isolating fastener may include an electrically insulating sleeve extending between the lower fastening aperture and the upper fastening aperture and receiving an electrically conductive bolt having a head adjacent one of the upper mounting lip or lower mounting lip and an electrically conductive nut threaded onto the bolt and adjacent the other of the upper mounting lip or lower mounting lip, a first electrically isolating spacer compressed between the head and the one of the upper mounting lip or lower mounting lip and a second electrically isolating spacer compressed between the nut and the other of the upper mounting lip or lower mounting lip.

At least one of the insulating sleeve, the first electrically isolating spacer and the second electrically isolating spacer may be formed from the same material as the isolating flange.

A heater may be used to keep the interior chamber at an operating temperature that is higher than the a freezing temperature of the lithium-alloy feedstock material, the molten salt electrolyte material and the lithium metal.

The heater may include a heating element in contact with an outer surface of the housing.

The heater may include a furnace chamber having an interior that is maintained at or above the operating temperature, and the housing may be disposed within the interior of the furnace chamber.

An electrolyte reservoir may be external the interior chamber of the housing and may be disposed within the furnace chamber, whereby electrolyte material contained within the electrolyte reservoir is maintained at or above the operating temperature.

A feedstock reservoir may be external the interior chamber of the housing and may be disposed within the furnace chamber, whereby lithium-alloy feedstock material contained within the feedstock reservoir is maintained at or above the operating temperature.

The cathode may be formed from a material that is electrically conductive but not reactive to the lithium metal.

The cathode may be formed from stainless steel.

The housing may extend horizontally between a first housing end and an opposing second housing end, and may include a feedstock inlet disposed toward the first housing end and in communication with the anode layer through which the lithium-alloy feedstock material can enter the housing. A feedstock outlet may be disposed toward the second housing end and may be in communication with the anode layer through which the lithium-alloy feedstock material can be withdrawn from the interior chamber, whereby when the apparatus is in use the lithium-alloy feedstock material in the anode layer flows in a first flow direction through the housing from the feedstock inlet to the feedstock outlet.

The lithium-alloy feedstock material entering the feedstock inlet may contains more lithium metal than the lithium-alloy feedstock material exiting the feedstock outlet.

A feedstock reservoir may contain the lithium-alloy feedstock material that is external the housing and may be fluidly connected to the feedstock inlet via a feedstock circulation circuit.

The feedstock circulation circuit may be configured so that at least a portion of the lithium-alloy feedstock material exiting the feedstock outlet is returned to the feedstock reservoir.

An electrolyte inlet may be disposed toward the first housing end and in communication with the electrolyte layer through which the electrolyte material can enter the interior chamber. A electrolyte outlet may be disposed toward the second housing end and may be in communication with the electrolyte layer through which the electrolyte material can be withdrawn from the interior chamber, whereby when the apparatus is in use the electrolyte in the electrolyte layer flows in the first flow direction through the housing from the electrolyte inlet to the electrolyte outlet.

An electrolyte reservoir may contain the electrolyte material that is external the housing and may be fluidly connected to the electrolyte inlet via a electrolyte circulation circuit.

The electrolyte circulation circuit may be configured so that at least a portion of the electrolyte material exiting the electrolyte outlet is returned to the electrolyte reservoir.

An electrolyte settling chamber may be disposed between the electrolyte inlet and the electrolyte layer and may be configured to receive and temporarily contain the incoming electrolyte material, whereby the electrolyte material exiting the electrolyte settling chamber is less turbulent than the electrolyte material entering the electrolyte settling chamber.

The interior chamber may include a gas headspace disposed above the product layer and containing a cover gas that is substantially free from oxygen, carbon dioxide, nitrogen and water vapour to inhibit oxidation, carbonation, hydration and nitration of the lithium metal in the product layer.

The cover gas may include at least one of argon, helium, a fluorocarbon gas and a hydrocarbon gas that comprises at least one of propane, butane, hexane, and mixtures thereof.

The cover gas may include less than 4 ppm oxygen, less than 4 ppm carbon dioxide, less than 4 ppm nitrogen and less than 3.5 ppm water vapour.

The cover gas may include argon.

The cover gas may flow through the gas headspace while the apparatus is in use at a gas flow rate.

The electrolyte material may include at least one of chloride, fluoride, iodide, bromide, sulphate, nitrate and carbonate salts, and mixtures thereof.

The electrolyte material may include at least one of LiCl—KCl, LII-KI and LiI—CsI.

The electrolyte material may include a mixture of LiCl—KCl, LII-KI and LiI—CsI.

The electrolyte material may be a eutectic mixture of LiCl—KCl, LII-KI and LiI—CsI, in which the concentrations are 46% LiCl-54% KCl (by weight), 58.5% LII-41.5% KI (by weight) and 45.7% LiI-54.3% CsI (by weight).

The apparatus may be operable with the activation electric potential at between about 0V and about 3.6V and at a current of between about 4 and about 20 A.

The apparatus may be operable at a current of between about 4 and about 20 A.

The activation electric potential may be between 0.6V and about 1.0V.

A current density between the anode layer and the cathode may be between about 0.001 or 100 A/cm$^2$.

The current density may be between about 0.05 or 1.5 A/cm$^2$

The current density may be between about 0.15-0.75 A/cm$^2$.

The current density may be equal to or greater than 0.25 A/cm$^2$. relative to the cathode area.

In accordance with another broad aspect of the teachings described herein, an electrorefining process for refining relatively purer lithium metal from a lithium-alloy feedstock material using a three-layer electrorefining apparatus having a housing defining an interior chamber, may include the steps of:

a) providing a anode layer comprising a molten, lithium-alloy feedstock material that includes a combination of lithium metal having a first purity and a carrier material;

b) providing an electrolyte layer comprising a molten salt electrolyte material above the anode layer and within the interior chamber;

c) providing a product layer comprising molten lithium metal having a second purity that is greater than the first purity above the electrolyte layer within the interior chamber; and d) applying an activation electric potential that is sufficient to electrolyze the lithium-alloy feedstock material between the anode layer comprising the lithium-alloy feedstock material and the product layer that is electrically isolated from the anode layer, whereby lithium metal is separated from the lithium-alloy feedstock material, migrates through the electrolyte layer and collects in the product layer.

The process may include removing lithium metal from the product layer while the apparatus is in use via a refined metal extraction apparatus in fluid communication with the upper layer.

The process may include concurrently, with step d), introducing a flow the lithium-alloy feedstock material into the interior chamber via a feedstock inlet in communication with the anode layer, conveying the lithium-alloy feedstock material through the interior chamber in a first flow direction and extracting a flow of the lithium-alloy feedstock material from the interior chamber via a feedstock outlet, wherein the lithium-alloy feedstock material entering via the feedstock inlet contains more lithium metal than the lithium-alloy feedstock material extracted via the feedstock outlet.

The process may include, concurrently with step d), introducing a flow the electrolyte material into the interior chamber via a electrolyte inlet in communication with the electrolyte layer, conveying the electrolyte material through the interior chamber in the first flow direction and extracting a flow of the electrolyte material from the interior chamber via a electrolyte outlet.

The process may include inhibiting mixing between the anode layer and the electrolyte layer by conveying the lithium-alloy feedstock material through the interior chamber as a substantially laminar flow and conveying the electrolyte material through the interior chamber as a substantially laminar flow.

The process may include directing the flow of the electrolyte material through an electrolyte settling chamber that is located within the interior chamber between the electrolyte inlet and the electrolyte layer, thereby reducing the turbulence of the flow of electrolyte material entering the electrolyte layer.

The process may include directing the flow of the lithium-alloy feedstock material along a feedstock circulation circuit outside the housing and fluidly connecting the feedstock outlet and the feedstock inlet and including a feedstock reservoir from which the lithium-alloy feedstock material is supplied to the feedstock inlet.

The process may include recycling at least a portion of the lithium-alloy feedstock material extracted from the feedstock outlet to the feedstock reservoir.

The process may include directing the flow of the electrolyte material along an electrolyte circulation circuit outside the housing and fluidly connecting the electrolyte outlet and the electrolyte inlet and including an electrolyte reservoir from which the electrolyte material is supplied to the electrolyte inlet.

The process may include recycling at least a portion of the electrolyte material extracted from the electrolyte outlet to the electrolyte reservoir.

The process may include inhibiting oxidation, hydration and nitration of the lithium metal in the product layer by providing a cover gas that is substantially free from oxygen, carbon dioxide, nitrogen and water vapour to inhibit oxidation, carbonation, hydration and nitration of the lithium metal in the product layer within a gas headspace disposed above the product layer within the interior chamber.

The cover gas may include at least one of argon, helium, a fluorocarbon gas and a hydrocarbon gas that comprises at least one of propane, butane, hexane, and mixtures thereof.

The cover gas may include less than 4 ppm oxygen, less than 4 ppm carbon dioxide, less than 4 ppm nitrogen and less than 3.5 ppm water vapour.

The cover gas may include argon, helium or mixtures thereof.

The process may include conveying the cover gas through the gas headspace at a gas flow rate while the apparatus is in use.

The lithium-alloy feedstock material may have a density that is greater than a density of the electrolyte material and is greater than 1.6 g/cm3.

A vapour pressure of the lithium-alloy feedstock material may be at least 10 times lower than a vapour pressure of the lithium metal in the product layer.

The molten salt electrolyte material may have a density that is less than the density of lithium-alloy feedstock material and is greater than 0.6 g/cm3.

A concentration of the lithium metal in the lithium-alloy feedstock material may be equal to or less than about 80 at %.

The lithium metal in the lithium-alloy feedstock material may be equal to or greater than 0.1 at %.

The carrier material may include at least one of bismuth, tin, aluminum, indium, thallium, copper, iron and alloys thereof.

The carrier material may include at least two of bismuth, indium and tin.

The carrier material may include bismuth, indium and tin.

The concentration of bismuth within the carrier material may be between 0 wt %-80 wt %, and optionally between 30 wt %-60 wt %.

The concentration of indium metal within the carrier material may be between 0 wt %-80 wt %, and optionally between 22 wt %-60 wt %.

The concentration of tin within the carrier material may be between 0 wt %-80 wt %, and optionally between 10 wt %-60 wt %.

The lithium-alloy feedstock material may have a melting temperature that is between 200-800 deg. C.

The lithium-alloy feedstock material may have a melting temperature that is less than 600 deg. C.

The electrolyte material may include at least one of chloride, fluoride, iodide, bromide, sulphate, nitrate and carbonate salts, and mixtures thereof.

The electrolyte material may include at least one of LiCl—KCl, LII-KI and LiI—CsI.

The electrolyte material may include a mixture of LiCl—KCl, LII-KI and LiI—CsI.

The electrolyte material may be a eutectic mixture of LiCl—KCl, LII-KI and LiI—CsI, in which the concentrations are 46% LiCl-54% KCl (by weight), 58.5% LII-41.5% KI (by weight) and 45.7% LiI-54.3% CsI (by weight).

The apparatus may be operable with the activation electric potential at between about 0V and about 3.6V.

A current density between the anode layer and the cathode may be between about 0.001 or 100 A/cm$^2$, or may be between about 0.05 or 1.5 A/cm$^2$, or may be between about 0.15-0.75 A/cm$^2$, or may be equal to or greater than 0.25 A/cm$^2$.

BRIEF DESCRIPTION OF THE DRAWINGS

Embodiments of the present disclosure will be described with reference to the accompanying drawings, wherein like reference numerals denote like parts, and in which.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
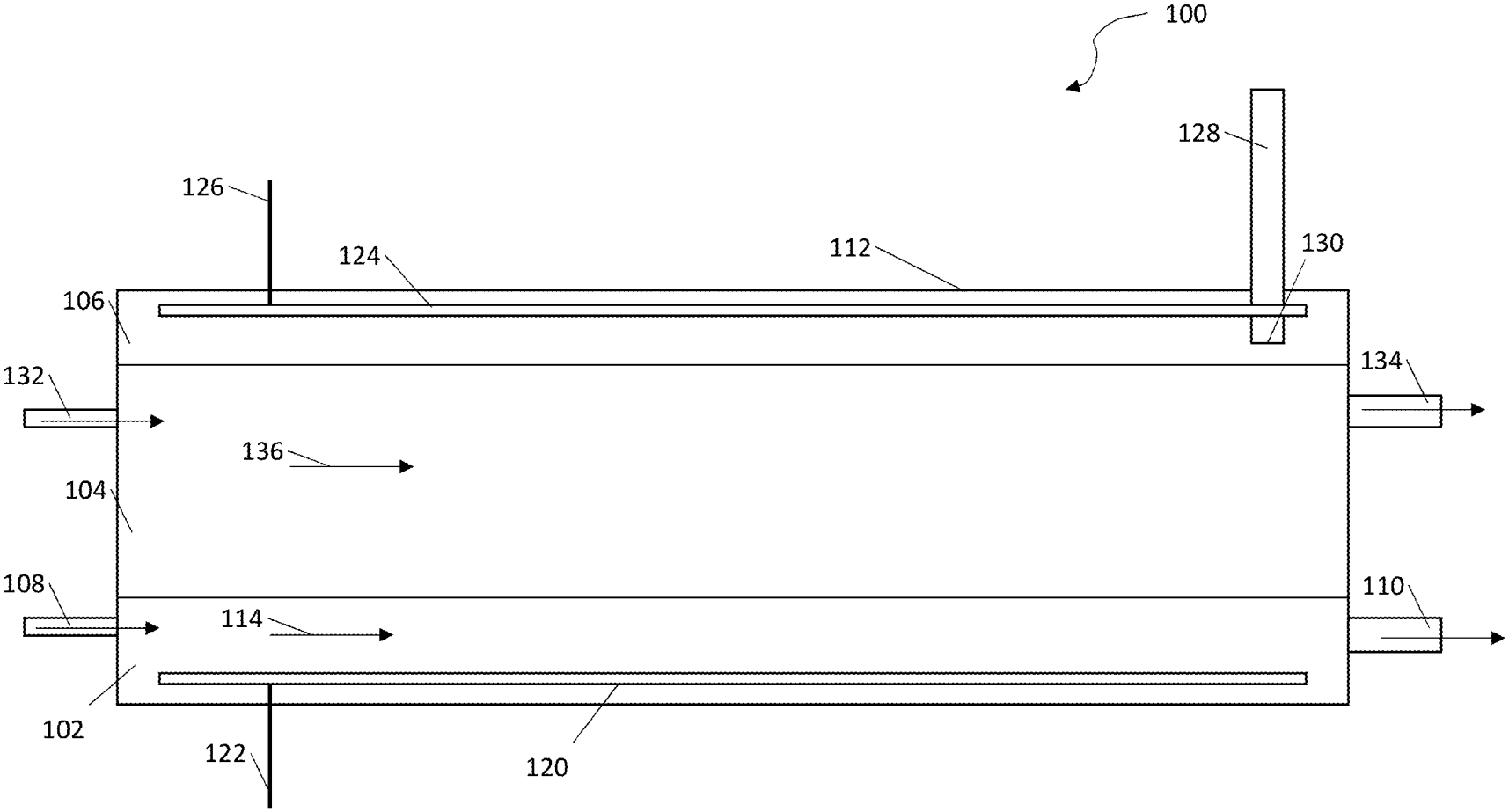
FIG. 1 is a schematic representation of one example of an electrorefining cell.

Referring to FIG. 1, a schematic representation of one example of an electrorefining cell 100 that is configured to refine relatively purer lithium metal from a lithium-alloy feedstock material is illustrated. In this example the cell 100 includes housing 112 that defines an interior chamber that is configured to retain the materials described herein and can be formed in any suitable shape or configuration. In this example, the cell 100 can be described as a three-layer cell as it is configured to accommodate a lower, anode layer 102 that includes a liquid feedstock material (in the form of the lithium-alloy feedstock material in this example), an intermediate, electrolyte layer 104 including a suitable liquid electrolyte material as described herein, and an upper, product layer 106 that contains a seed amount of the refined metal product when the cell 100 is started and in which, when an activation electric potential that is sufficient to electrolyze the lithium-alloy feedstock material is applied within the cell 100 (as described herein), lithium metal that is liberated from the lithium-alloy feedstock material can collect after it, migrates through the electrolyte layer 104.

In this schematic example, the cell 100 is configured as an elongate, conduit-like apparatus that is configured as a flow-through apparatus (i.e. the material in layers 102 and optionally 104 are flowing while the cell 100 is in use). In such arrangements, the cell 100 is preferably oriented generally sideways and arranged to be generally level, such that the free surfaces of the lower layer 102 and intermediate layer 104 are substantially flat and horizontal when the cell is in use 100 (as illustrated). This can help prevent unwanted flow characteristics, reaction properties and/or mixing between the layers.

To help facilitate the desired electrorefining process/reaction, the cell 100 includes at least one suitable anode conductor member 120 that is electrically connected to a suitable power source via connection 122, and a corresponding cathode conducting member as described below. The anode conductor member 120 is positioned to apply a charge to the lithium-alloy feedstock material in the lower layer 102. The anode conductor member 120 may optionally, include an electrical conductor that is located within the interior chamber bounded by the housing 112 and is at least partially submerged in or otherwise in electrical contact with the lower layer 102 (such as conductor 120*a* in this schematic example). In other examples described herein, a sidewall or other suitable portion of the housing 112 itself that is in sufficient electrical contact with the lower, anode layer 102 may itself be electrically conductive and may be configured to function as a suitable anode. Optionally, if the feedstock material is electrically conductive it may act as the anode, and may be partially consumed, while the cell 100 is in use. The anode conductor member 120 (whether free standing or integrated into the housing sidewall) can be formed from any suitably electrically conductive material, and is preferably formed from the cathode is a material that is not wettable by, or is generally non-reactive with, the lithium metal, or may be made from stainless steel.

Similarly, the cell 100 includes at least one suitable cathode conducting member 124 that is located toward the top of the housing 112, connected to a suitable power source via connection 126 and can be in contact with the electrolyte and the refined lithium metal in the upper layer 106 when the cell 100 is in use. The cathode conducting member 124 is arranged as to be electrically isolated from the anode conductor member 120 and anode layer 102 and to apply its charge to an initial seed of the relatively purer lithium metal in the product layer 106, and to the rest of the lithium metal that accumulates in the product layer 106 while the cell 100 is in use, whereby the refined lithium in the product layer 106 (and the product layer 106 itself) functions as the cathode. In this arrangement, when the cell 100 is in use, and a suitable, activation electric potential is applied between the anode layer 102 and product layer 106 (e.g. an electric potential that is sufficient to electrolyze the lithium-alloy feedstock material) lithium metal is liberated/stripped from the feedstock material, can migrate upwardly through the electrolyte in the intermediate, electrolyte layer 104 and can then collects in the upper, refined metal layer 106 (proximate the cathode conducting member 124) where it can be extracted from the cell 100 using any suitable refined metal extraction system.

In the illustrated example, the refined metal extraction system includes a refined metal extraction conduit 128 having an inlet end 130 that is located inside the housing 112 and in fluid communication with the refined metal-containing, upper, product layer 106 In the illustrated example the refined lithium metal may by at least partially driven thorough the refined metal extraction conduit 128 via the hydrostatic pressure within the housing 112. Optionally, the refined metal extraction conduit 128 can also be connected to any suitable vacuum or flow control apparatus to help motivate the flow of the refined metal, and a suitable refined metal collection or storage vessel.

Preferably, the exposure of the refined lithium metal to oxygen or other potential contaminants while it is in the product layer 106 can be inhibited or minimized, which may help prevent the unwanted reactions. Optionally, the cell 100 can include a gas headspace 107 that is defined as the space within the interior chamber that is above the product layer 106 and is in communication with the exposed, free surface of the product layer 106. The gas headspace 107 preferably contains a cover gas that is preferably substantially free from oxygen, carbon dioxide, nitrogen and water vapour to inhibit oxidation, carbonation, hydration and nitration of the lithium metal in the product layer. The cover gas could be any suitable gas or mixture of gases including argon, helium, a fluorocarbon gas and a hydrocarbon gas that comprises at least one of propane, butane, hexane, and mixtures thereof and other relatively inert gases that will not react with the refined lithium under the conditions that are expected within the cell 100.

Optionally, the cover gas can be circulated and/or flowing through or within the gas headspace 107 while the cell 100 is in use. The cover gas may be fed through the cell 100 at any suitable gas flow rate, which may be, in some examples between 10-20 scfm.

Figure 9:
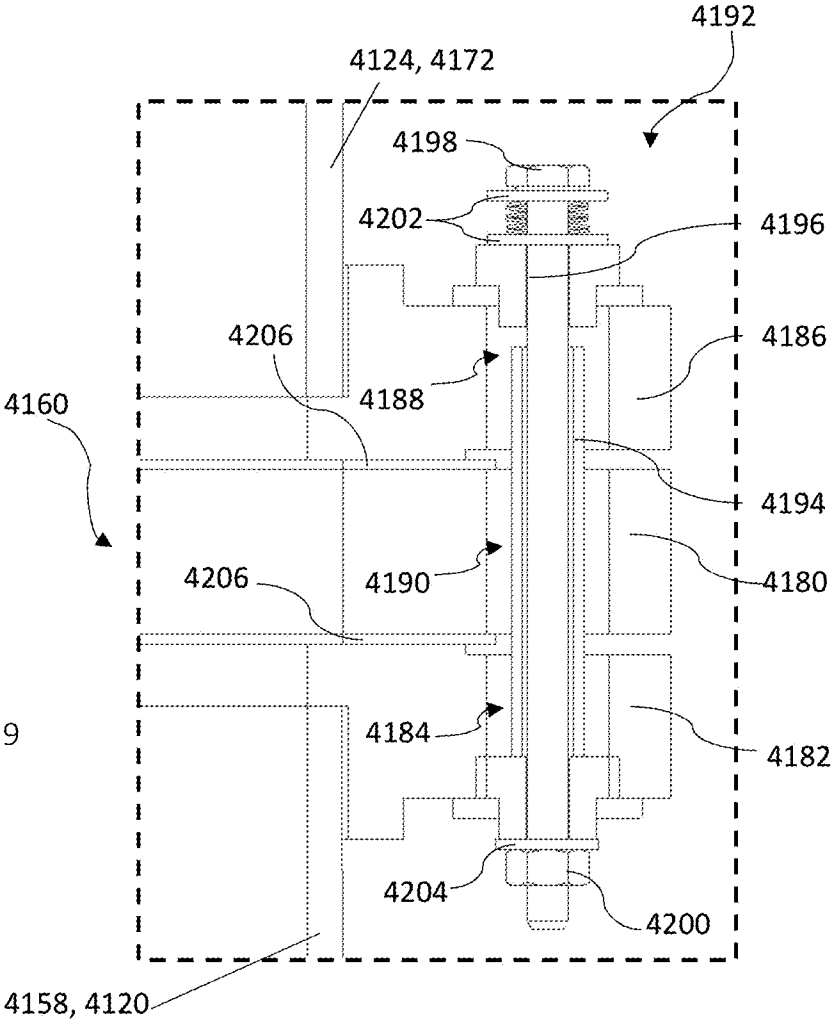
FIG. 9 is an enlarged view of a portion the electrorefining cell of FIG. 7.
Figure 10:
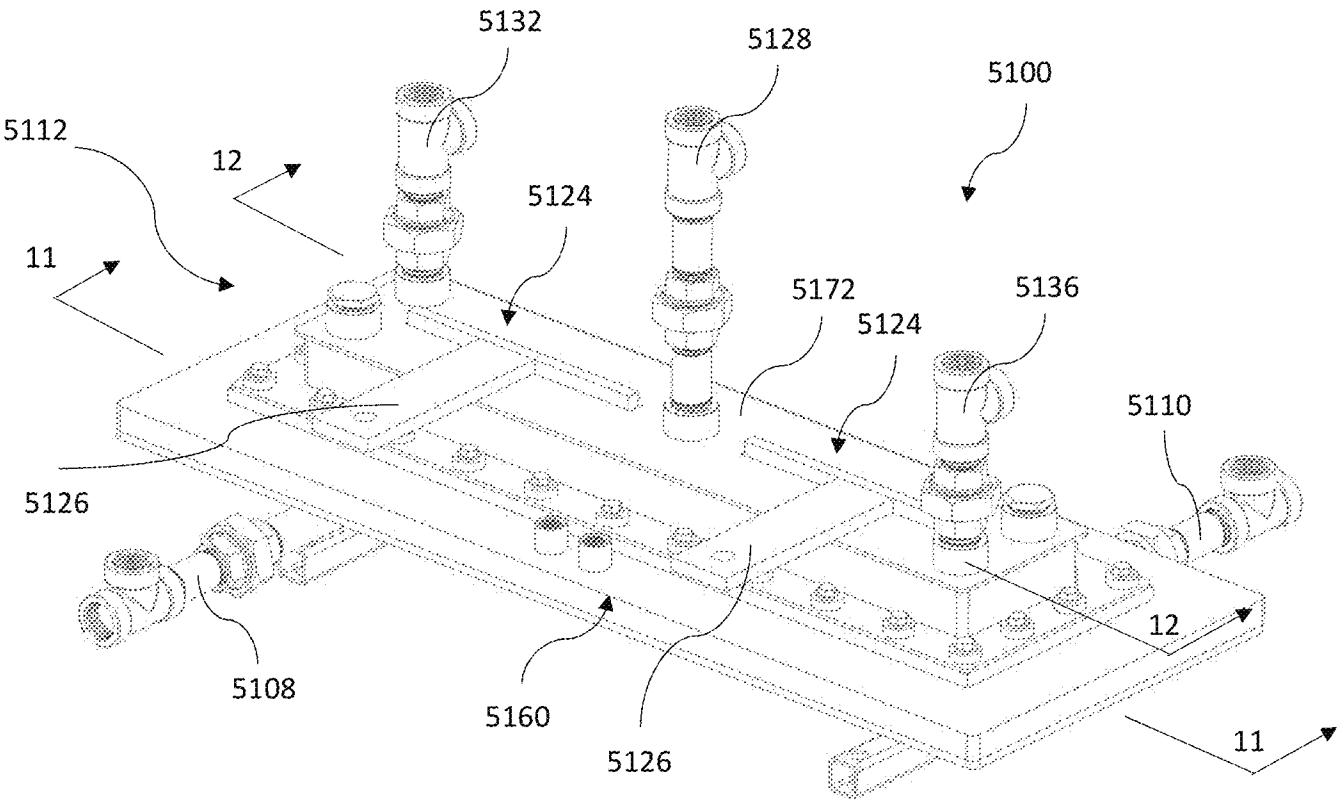
FIG. 10 is a perspective view of another example of an electrorefining apparatus.
Figure 11:
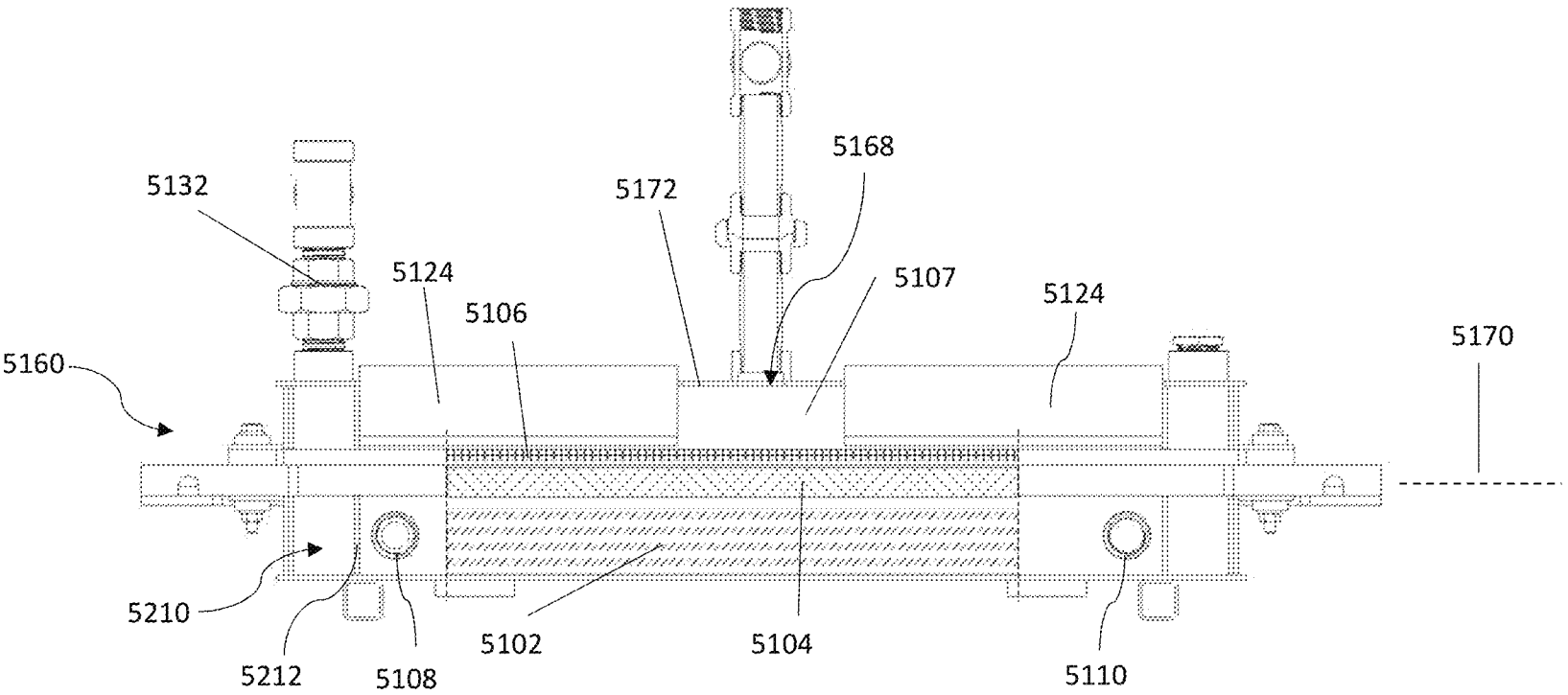
FIG. 11 is a side cross-sectional view of the electrorefining cell of FIG. 10, taken along line 11-11.

Optionally, as described in this example, the cell 100 can be configured as a flow-through cell, in which at least one of the feedstock and the electrolyte, and preferably both the feedstock and the electrolyte materials are provided in a liquid/molten form such that they can and do flow through the cell 100 (within their respective layers 102 and 104) while it is in use (as compared to a static or batch type of process where both the feedstock and the electrolyte are not flowing while the apparatus is in use—for example see FIGS. 9-11). This may allow the cell 100 to be used in an online or real-time basis and in combination with an online or ongoing lithium production process that produces a generally continuous stream/flow of the unrefined lithium metal and lithium-alloy feedstock material. Preferably, the cell 100 is operated so that the liquids flow through the cell 100 with relatively slow velocities/mass flow rates and under generally laminar flow conditions, which may help reduce turbulence or mixing between the layers 102, 104 and 106 while the cell is in use. The flow rates of the feedstock alloy and the electrolyte material (such as a molten salt) can be different from each other, or may be the same.

Preferably, to help maintain the desired 3-layer arrangement, the wherein the lithium-alloy feedstock material is created so that it has a density that is greater than the density of the electrolyte material in layer 104, and preferably can be greater than 1.6 g/cm$^3$, and optionally may be equal to or greater than 2.15 g/cm$^3$. Similarly, it can be preferred that the electrolyte material has a density that is less than the density of lithium-alloy feedstock material (so that it will generally float on anode layer 102) and is greater than the density of the refined lithium metal, e.g. greater than about 0.6 g/cm$^3$, so that the product layer 106 will float on the electrolyte layer 104.

To help accommodate the desired material flows in this schematic illustration, the cell 100 includes a feedstock inlet 108 at one end of the housing 112 and a feedstock outlet 110 that is spaced apart from the feedstock inlet 108 in a first, feedstock flow direction (shown by arrow 114). In the illustrated schematic the feedstock outlet 110 is at the opposing end of the housing 112, but could be in other suitable locations in other examples of an electrorefining cell. Preferably, the feedstock inlet 108 and outlet 110 are located in a lower portion of the housing 112 and are positioned to be in communication with the anode layer 102 while the cell 100 is in use. The specific height and position of the feedstock inlet 108 and outlet 110 may vary in different cell configurations.

The feedstock inlet 108 and outlet 110 can include any suitable flow control mechanisms, such as valves, orifices, nozzles and the like to help control and direct the flow of the feedstock material as desired. The feedstock inlet 108 is preferably fluidly connected to a suitable source of the feedstock material that is to be refined, such as feedstock reservoir, and the feedstock outlet 110 is preferably connected to a suitable sink/storage location for receiving the reacted (and relatively lithium-poor because the lithium has migrated to the product layer 106) lithium-depleted alloy material that exits the cell 100 when in use. One or both of the feedstock source and the feedstock sink may include a suitable tank or vessel that is connected to the cell 100 using any suitable pipes, conduits and the like. Optionally, the feedstock source and the feedstock sink may be combined together in a common reservoir vessel, such that the reacted, lithium-depleted alloy material exiting the cell 100 returns to the reservoir vessel and mixes with new, unreacted relatively lithium-rich feedstock liquid and/or additional crude lithium metal feed material can be added into the reservoir vessel to increase the lithium content of the lithium-alloy feedstock within the reservoir vessel. Then, some of that lithium-alloy feedstock material can be withdrawn from the reservoir vessel and fed back into the cell via inlet 108. Preferably, the cell 100 can be connected to a suitable feedstock alloy reservoir or source/sink vessel via a feedstock circulation system that can also include any suitable conduits, pumps, flow control mechanisms, system controllers and the like.

The molten, lithium-alloy feedstock material that is supplied to the cell 100 and that forms the anode layer 102 can be of any suitable alloy composition that includes the target metal that is to be refined (e.g. lithium in these examples) along with one or more suitable carrier metal. In this example, the cell 100 is configured to refine lithium metal and incoming feedstock liquid is a molten, lithium-rich, metallic alloy liquid that contains crude lithium metal at a first purity alloyed with a carrier material that includes one or more suitable base or carrier metal. Some examples of suitable carrier metals that can be used in the feedstock alloy include lead, bismuth, tin, zinc, indium, thallium, gallium, copper, iron, etc. and their alloys. The purity of the crude lithium metal that is added to the feedstock material can preferably be about 80-99.9 at %, but may be lower than 80 at % in some examples. In addition to the relative purity of the incoming crude lithium metal, the lithium-alloy feedstock is also preferably prepared so that the concentration of lithium metal within the feedstock alloy may be between about 1 at % and about 80 at %, and preferably is less than about 80 at % because higher lithium content may alter some of the properties of the resulting lithium-alloy feedstock material in undesirable ways. This is understood to be the concentration of lithium metal in the overall lithium-alloy feedstock material, and does not include the contaminants or other non-lithium components of the incoming crude lithium metal material.

The applicant has tested various different compositions of the lithium-alloy feedstock material and has determined that a lithium-alloy feedstock material that includes a combination of lithium and at least at least two of bismuth, indium and tin can give some relatively desirable properties, and preferably the lithium-alloy feedstock material can be created to include a combination of lithium, bismuth, indium and tin. Optionally, in this arrangement the concentration of bismuth within the carrier material can be between 0 wt %-80 wt %, and optionally may be between 30 wt %-60 wt %, the concentration of indium metal within the carrier material can be between 0 wt %-80 wt %, and optionally may be between 22 wt %-60 wt %, and the concentration of tin within the carrier material can be between 0 wt %-80 wt %, and optionally may be between 10 wt %-60 wt %. These compositions have been tested and found to provide a lithium-alloy feedstock material having a relatively low melting point. Preferably, the lithium-alloy feedstock material is created so that it has a melting temperature that is less than 600 degrees Celsius, and optionally can be less than 580, 560, 550, 525, 500, 480, 460, 450, 420 degrees Celsius. In some configurations, the melting temperature of the lithium-alloy feedstock material is between 100-1000 degrees Celsius, or between 200-800 or 400-600 degrees Celsius, and may be between about 420-550 degrees Celsius. In some examples, the melting temperature can be less than 600 degrees Celsius. In these examples, the operating temperature of the cell 100 can be reduced to a level that is equal to, or preferably at least slightly greater than these melting temperatures, which may help reduce the energy consumption of the cell 100.

To help accommodate the desired electrolyte flows, the cell 100 includes an electrolyte inlet 132 at one end of the housing 112 and a feedstock outlet 134 that is spaced apart from the feedstock inlet 132 in a feedstock flow direction (shown by arrow 136). In the illustrated schematic the electrolyte inlet 132 is at the same end of the housing 112 as the feedstock inlet 108, and the electrolyte outlet 134 is located at the same end of the housing 112 as the feedstock outlet 110, such that the cell 100 is configured in a co-flow arrangement. In other examples, the inlets and outlets may be in different locations, and the cell 100 may be arranged in a counter-flow arrangement (e.g. where flows 114 and 136 are in opposite directions). In yet further embodiments, at least one of the layers 102 and 104 (and optionally both of the layers 102 and 104) need not be flowing and may be relatively static while the cell is in use, such that the cell 100 is operated in a batch manner instead of a flow-through manner.

Preferably, the electrolyte inlet 132 and outlet 134 are located at a higher elevation than the feedstock inlet 108 and outlet and are positioned to be in communication with the electrolyte layer 104 while the cell 100 is in use. The specific height and position of the electrolyte inlet 132 and outlet 134 may vary in different cell configurations.

The electrolyte inlet 132 and outlet 134 can include any suitable flow control mechanisms, such as valves, orifices, nozzles and the like to help control and direct the flow of the feedstock material as desired. The electrolyte inlet 132 is preferably fluidly connected to a suitable source of the electrolyte, and the electrolyte outlet 134 is preferably connected to a suitable sink/storage location for receiving the electrolyte material that exits the cell 100 when in use. One or both of the electrolyte source and the electrolyte sink may include a suitable tank or vessel that is connected to the cell 100 using any suitable pipes, conduits and the like. Optionally, the electrolyte source and the electrolyte sink may be combined together in a common vessel, such that the electrolyte exiting the cell 100 returns to the vessel in a generally closed loop arrangement, while also being configured to allow for the addition of new electrolyte material into the system as needed. Preferably, the cell 100 can be connected to a suitable electrolyte source/sink vessel via an electrolyte circulation system that can also include any suitable conduits, pumps, flow control mechanisms, system controllers and the like.

The electrolyte material that is used to provide the electrolyte layer 104 can be any suitable material, and in the examples described herein is a molten salt that is flowable through the cell 100, if desired, and can include chloride, fluoride, iodide, bromide, sulphate, nitrate and carbonate salts, and mixtures thereof and similar salts of other metals to produce a relatively low-melting point lithium ion containing melt, such as for example LiCl—KCl, LiI—CsI or LiI—KI. Optionally, the electrolyte material may include at least one of, or a mixture of LiCl—KCl, LII-KI and LiI—CsI. In some examples, electrolyte material may be a eutectic mixture of LiCl—KCl, LII-KI and LiI—CsI, in which the concentrations are between 46% LiCl-54% KCl (by weight), 58.5% LII-41.5% KI (by weight) and 45.7% LiI-54.3% CsI (by weight).

When the cell 100 is in use, the relatively lithium-rich, lithium-alloy feedstock material is introduced into the cell 100 via the feedstock inlet 108 to provide the anode layer 102, and the molten salt electrolyte is introduced via the electrolyte inlet 132 to provide the electrolyte layer 104. An electric potential is applied across the anode layer 102 and cathode (e.g. the cathode conducting member 124 and the charged lithium metal in the product layer 106) whereby lithium metal is liberated from the feedstock material, migrates thorough the electrolyte layer 104 and collects toward the top of the housing 112 to provide the refined metal, product layer 106. The product layer 106 is seeded with a portion of relatively pure lithium metal at the start of the process. The feedstock material can exit via feedstock outlet 110 as a relatively lithium-depleted/lithium-lean alloy material, the electrolyte can be withdrawn via electrolyte outlet 134 and at least some of the refined lithium metal can be extracted from the refined layer 106. The refined lithium metal in the refined layer 106 can be at a second purity that is greater that the first purity of the lithium metal in the alloyed feedstock material, and preferably greater than 80%, 85%, 90%, 95% 98%, 99%, 99.9%, 99.99% pure and may be about 99.995% or higher purity in some examples.

One advantage of electrorefining using the electrorefining apparatuses and processes described herein may be that the cell 100 can be operated relatively low power consumption than alternatives, such as distillation. In the illustrated examples, the electrorefining cell 100 can be configured to operate at electropotentials of between about 0V and about 3.6V, or between about 0.6 and about 1.0V, which may allow operations with electrorefining power consumption less than 6 kW/kg metal produced. The cell 100 can be operated at any suitable current density, such as a current density between the anode layer and the cathode is between about 0.001 or 100 A/cm$^2$, or between about 0.05 or 1.5 A/cm$^2$, or between about 0.15-0.75 A/cm$^2$ and optionally can be configured to operate at a current density of at least 0.25 A/cm$^2$.

When operated as described herein, the interior of the electrorefining cell 100 is preferably at a suitable operating temperature that is at least greater than the melting points of the feedstock alloy, refined metal layer and the electrolyte. In some examples the operating temperature can be above 180, 200, 220, 240, 250, 270, 280, 300, 320, 340, 350, 360, 380, 400, 420, 440, 460, 480, 500, 600 degrees Celsius or more and may be less than about 700, 650, 600, 550, 500, 480, 460, 440, 420 degrees Celsius in some preferred examples.

Figure 2:
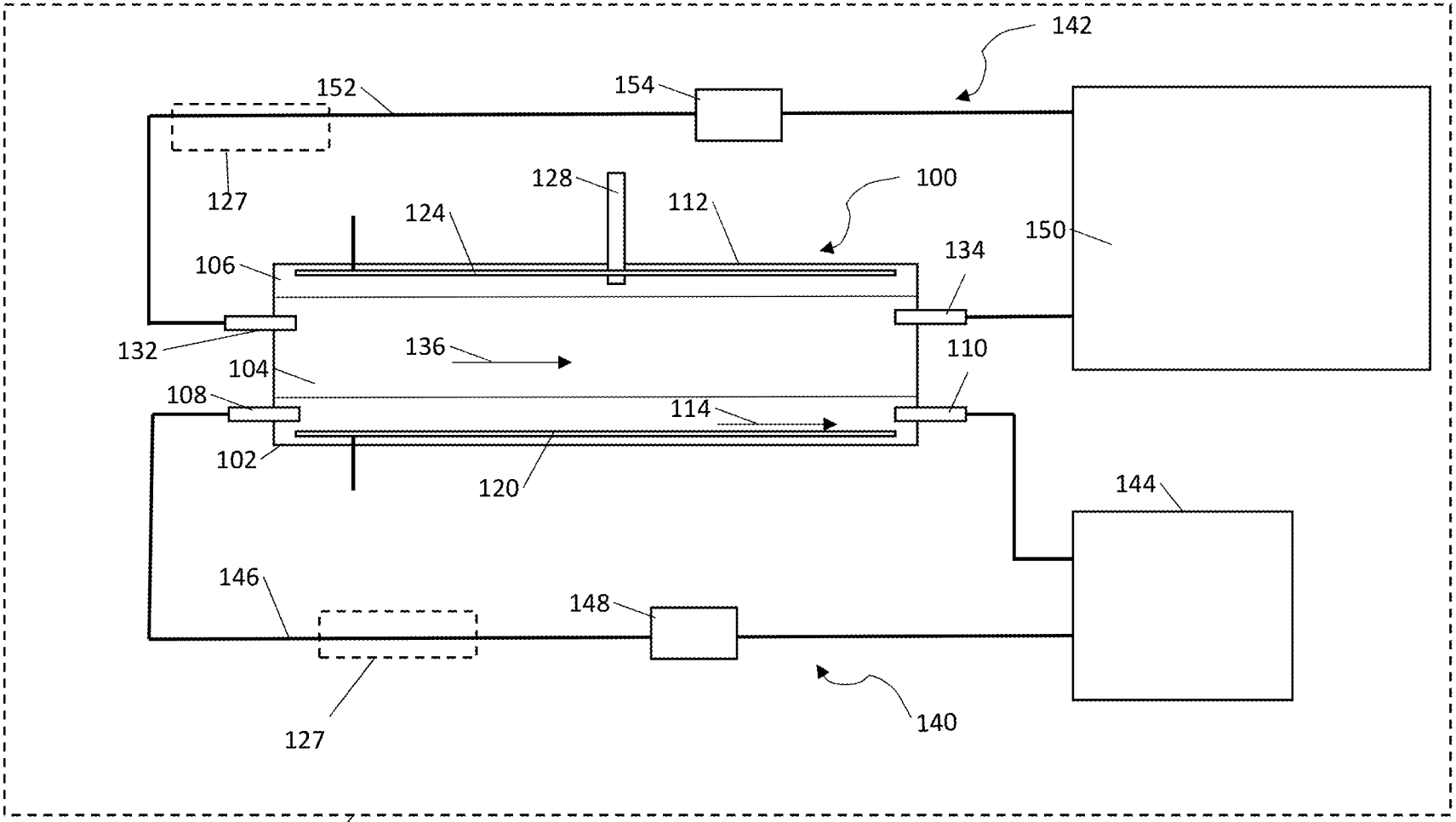
FIG. 2 is a schematic representation of one example an electrorefining apparatus including the electrorefining cell of FIG. 1.

Referring to FIG. 2, the cell 100 is schematically illustrated in combination with other components of an electrorefining apparatus, including a feedstock supply system 140 and an electrolyte supply system 142. In this example, the feedstock supply system 140 includes the feedstock inlet 108 and outlet 110, along with a suitable storage vessel/reservoir 144 and a feedstock circulation circuit 146 that includes a suitable pumping system 148 and other flow control features (not shown). In this arrangement, new, relatively less pure crude lithium metal that is to be refined can be added into the vessel 144 along with the alloying carrier metal material and these components may be mixed and heated within the vessel 144. Heating the materials in the reservoir vessel 144 may reduce the amount of heating that is required inside the interior chamber of the housing 112. Alternatively, the feedstock supply system 140 can include additional vessels for premixing the feedstock material before it is introduced within the vessel 144.

Optionally, the level of the feedstock material within the vessel 144, and/or the relative elevation of the vessel 144 relative to the housing 112 can be varied to change the hydrostatic pressure in the feedstock supply system 140, which may affect the pressure and level of the anode layer 102 within the cell 100. While illustrated as a single vessel 144, a suitable reservoir may include two or more tanks could be used (for example one for supplying the feedstock material and one for receiving material from the cell) with a pump or other suitable systems for balancing the pressures and flows of material therebetween.

This schematic representation of the electrolyte supply system 142 includes the electrolyte inlet 132 and outlet 134, along with an electrolyte source/sink vessel 150 and an electrolyte circulation circuit 152 that includes a suitable pumping system 154 and other flow control features (not shown)

While a single cell 100 is shown for simplicity in FIG. 2, an electrorefining system may include two or more such cells. The multiple cells 100 may also be provided with separate feedstock supply systems 140 and electrolyte supply systems 142, or alternatively two or more cells 100 may be connected to a common feedstock supply system 140 and/or electrolyte supply system 142—preferably in parallel with each other, but optionally in series.

Figure 3:
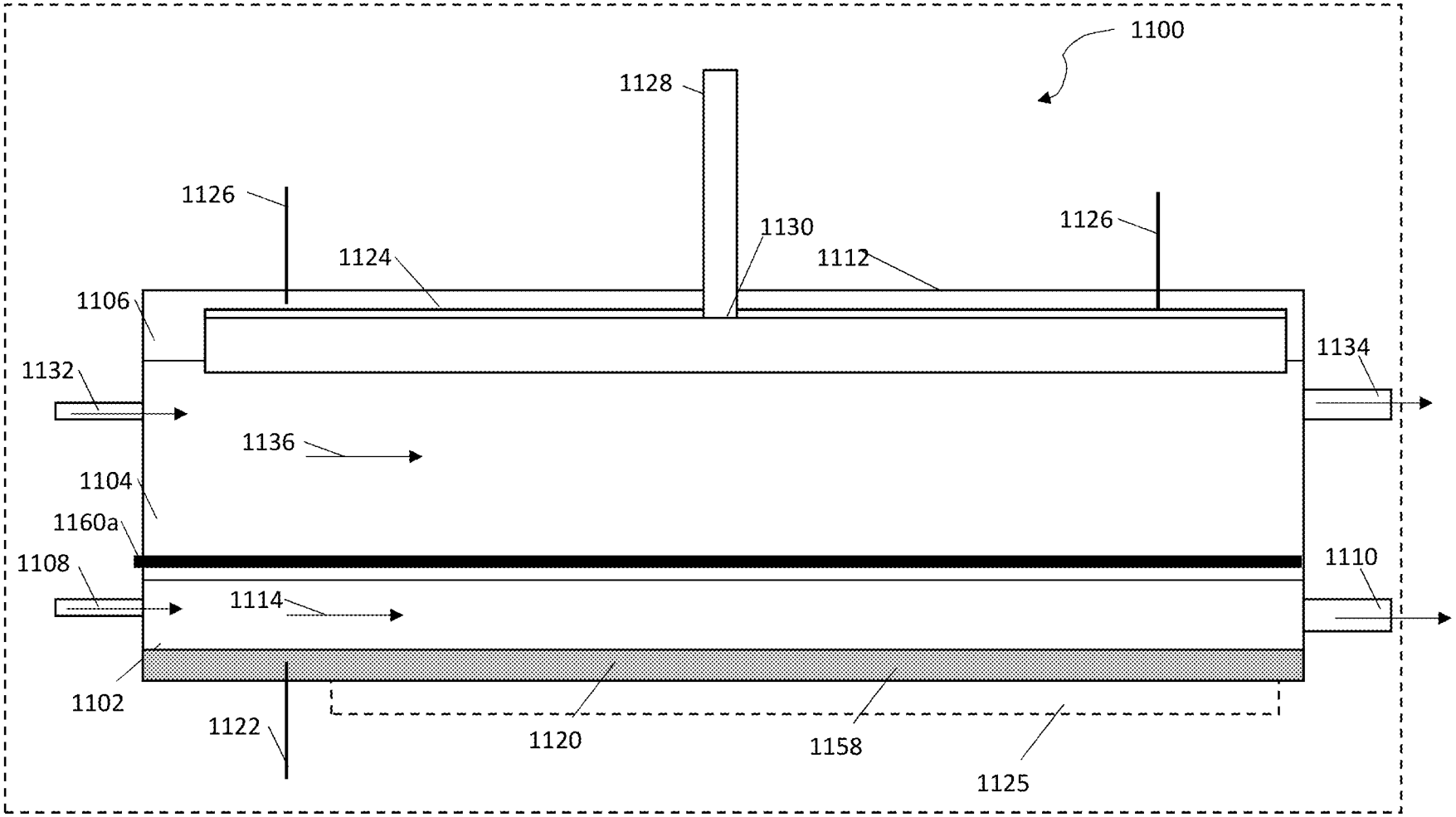
FIG. 3 is a schematic representation of another example of an electrorefining cell.

Referring to FIG. 3, another example of an electrorefining cell 1100 is illustrated. The cell 1100 is generally analogous to the cell 100 and like features are indicated using like reference characters indexed by 1000. In this example, the cell 1110 includes an anode layer 1102, having a respective feedstock inlet 1108 and feedstock outlet 1110, a refined metal or product layer 1106 and a layer of molten salt electrolyte in the electrolyte layer 1104 positioned therebetween, with a respective electrolyte inlet 1132 and electrolyte outlet 1134. In this example, instead of a separate member that is submerged within the anode layer 1102 the anode conductor member 1120 in the cell 1100 is provided by a conductive portion 1158 of the housing 1112 that is connected to a power source via the connection 1122 and in electrical contact with the metallic anode layer 1102, but that is electrically isolated from the cathode conducting member 1124. The isolated, anode portion 1158 of the housing can be electrically isolated from the cathode conducting member 1124 using an electrically insulating/isolating assembly 1160 that can include gaskets or other mounting structures, such as an axially extending insulator **1160*a* shown schematically in FIG. 3. This may help simplify construction of the cell 1100, and may help facilitate a desired flow of the metallic feedstock alloy in layer 1102 as a separate anode conductor member structure need nor protrude into the layer 1102** which might impede or disrupt the flow of the molten lithium-alloy feedstock of induce turbulence.

To help maintain the lithium-alloy feedstock and the electrolyte materials at the desired operating temperature, the apparatuses described herein can include any suitable type of heater that can be used to help keep the interior chamber at an operating temperature that is higher than the a freezing temperature of the lithium-alloy feedstock material, the molten salt electrolyte material and the lithium metal.

Optionally, a suitable heater can include a heating element in contact with an outer surface of the housing, such as contact heating element 1125 that is schematically illustrated in FIG. 3. Alternatively, or in addition to a housing heater like 1125, the system could include one or more inline heaters having heating elements that can heat the flows of the feedstock and electrolyte while they are outside of the interior chamber of the cell—such as the heaters 127 illustrated schematically in FIG. 2. Each of these heating elements, can include resistive heaters, heat exchanger coils and any other suitable heating mechanism.

Alternatively, or in addition to the heaters 127 or 1125, the heater used with the apparatus can be an external heating device that does not need to be in direct contact with the cell or the flowing materials. One example of such a device is a furnace chamber or other environment that is sized to contain the entirety of the cell, and optionally the feedstock and/or electrolyte material reservoirs and at least portions of the supply and recycle conduits. The interior of the furnace chamber can be heated to a temperature that is equal to, or preferably is slightly greater than the desired operating temperature of the cell. This ambient, environmental heating can heat the cell and its contents without exposing the heating elements to direct contact with the electrolyte or lithium metal, which may help reduce damage to the heating elements. Examples of such surrounding, furnace chambers are shown schematically as chambers 155 and 1155 in FIGS. 2 and 3 respectively. The chambers 155 and 1155 are shown in dashed lines to indicate they are optional features of these examples.

As shown in FIG. 2, the chamber 155 is configured to contain the cell 100, along with the reservoir vessels 144 and 150 and other portions of the material flow circuits. FIG. 3 shows another example, where chamber 1155 is configured to contain the cell 1100. The other cells described herein (including cells 2100, 3100, 4100 and 5100) may be placed within correspondingly configured furnace chambers to help keep the cells 2100, 3100, 4100 and 5100 and their contents at or above the desired operating temperatures without requiring direct contact heating elements on the housings or other exterior portions of the cells where they are prone to damage.

Figure 4:
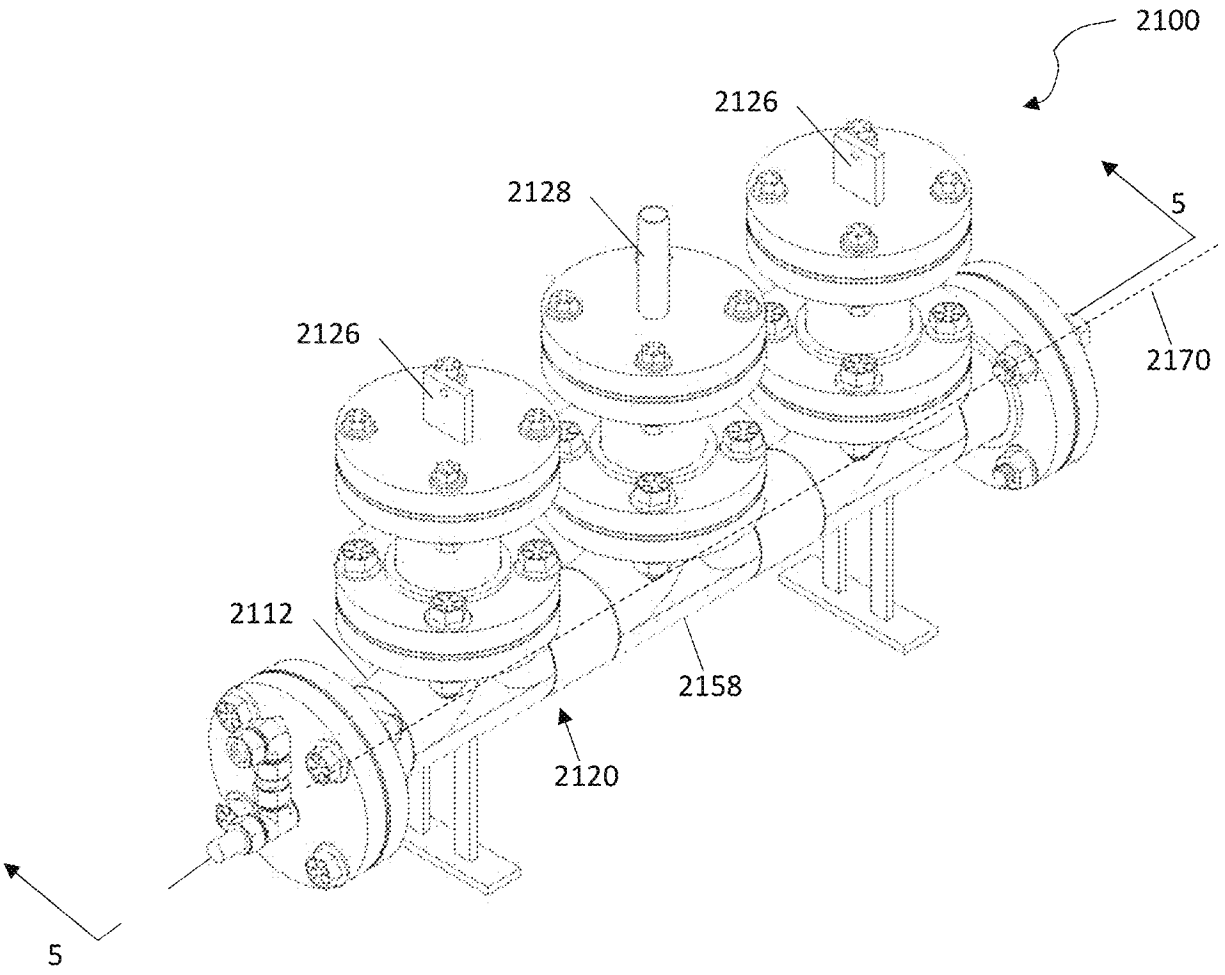
FIG. 4 is a schematic representation of another example of an electrorefining cell.
Figure 5A:
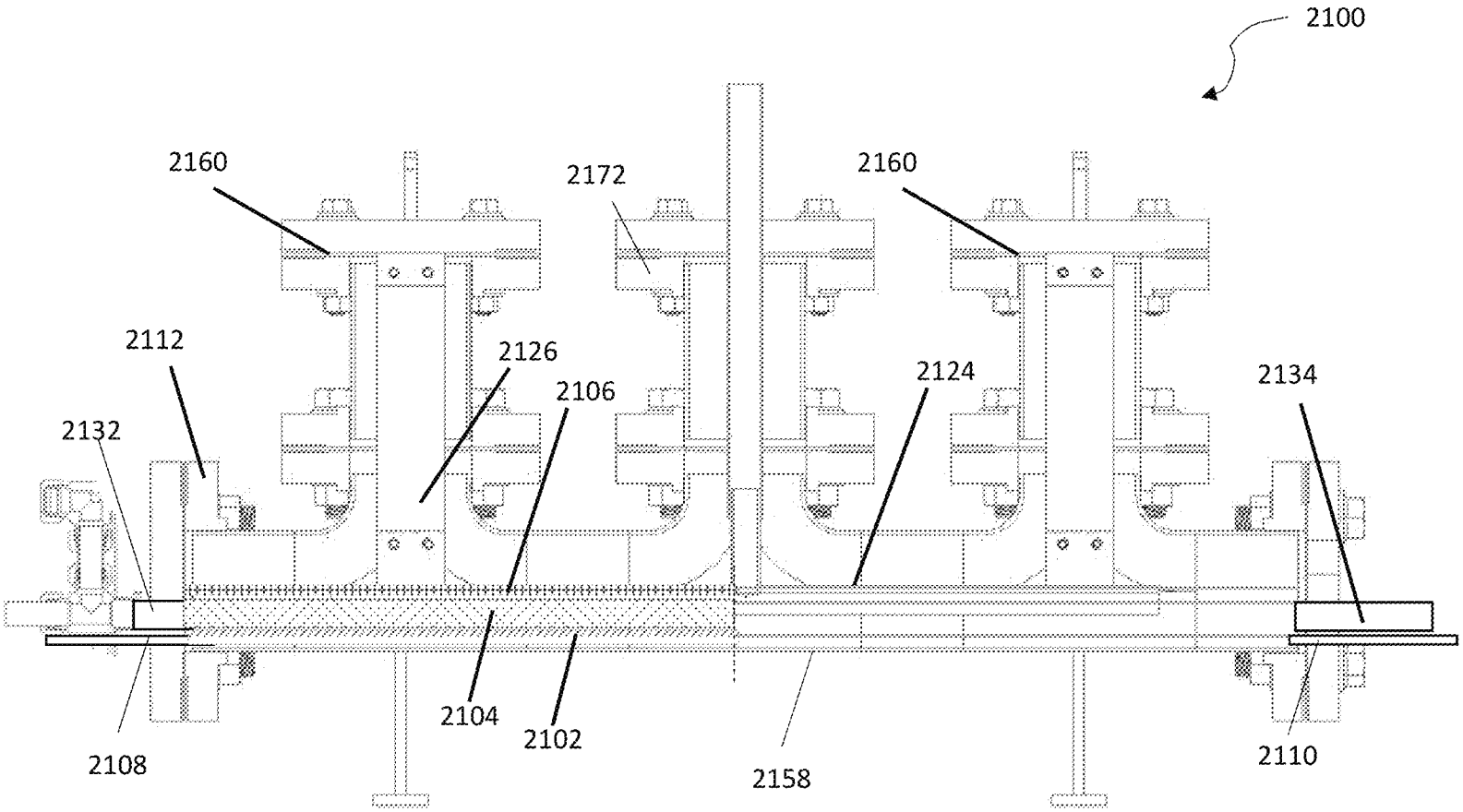
FIG. 5*a* is a side cross-sectional view of the electrorefining cell of FIG. 4, taken along line 5-5.
Figure 5B:
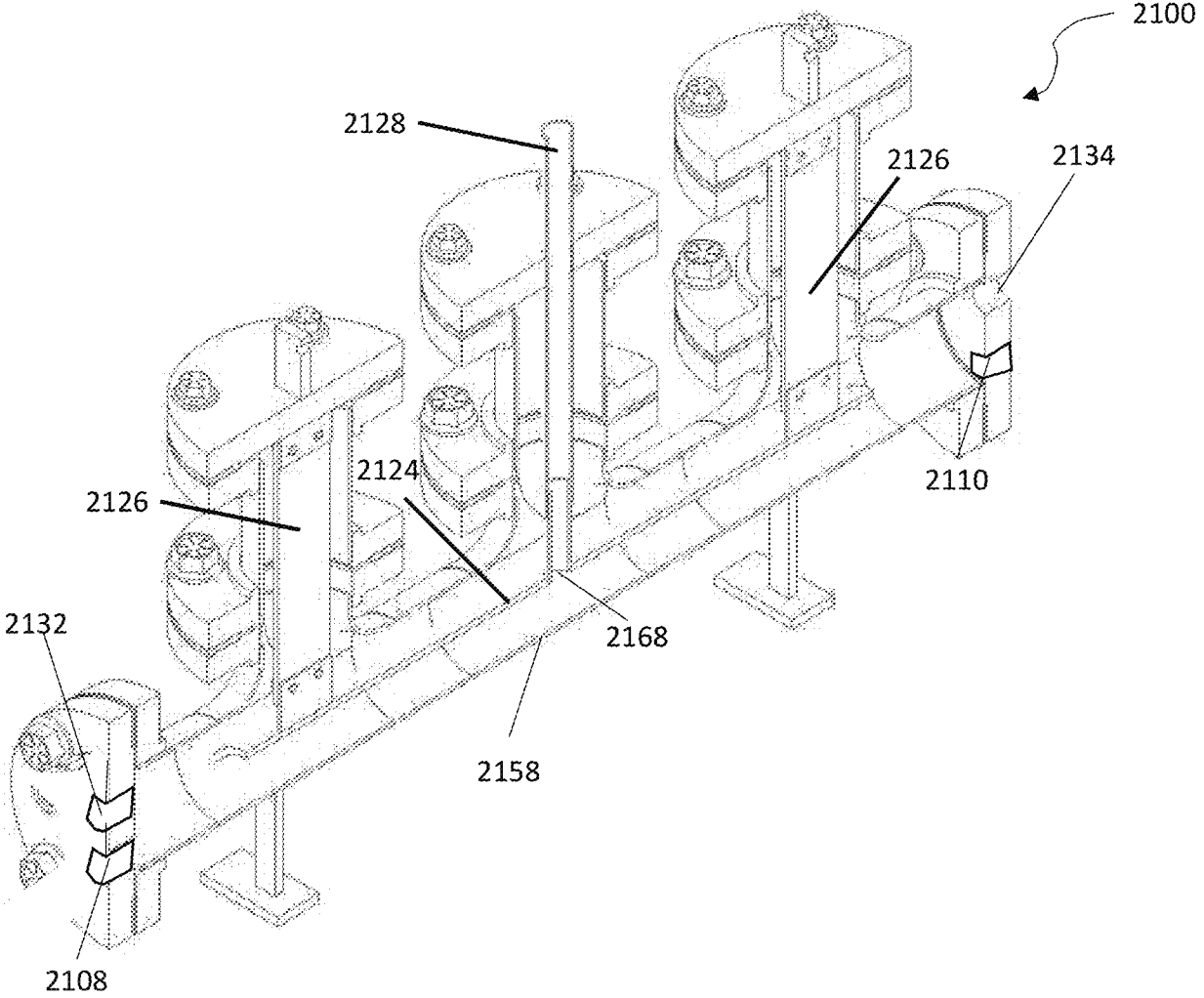
FIG. 5*b* is a perspective cross-sectional view of the electrorefining cell of FIG. 4, taken along line 5-5.
Figure 5C:
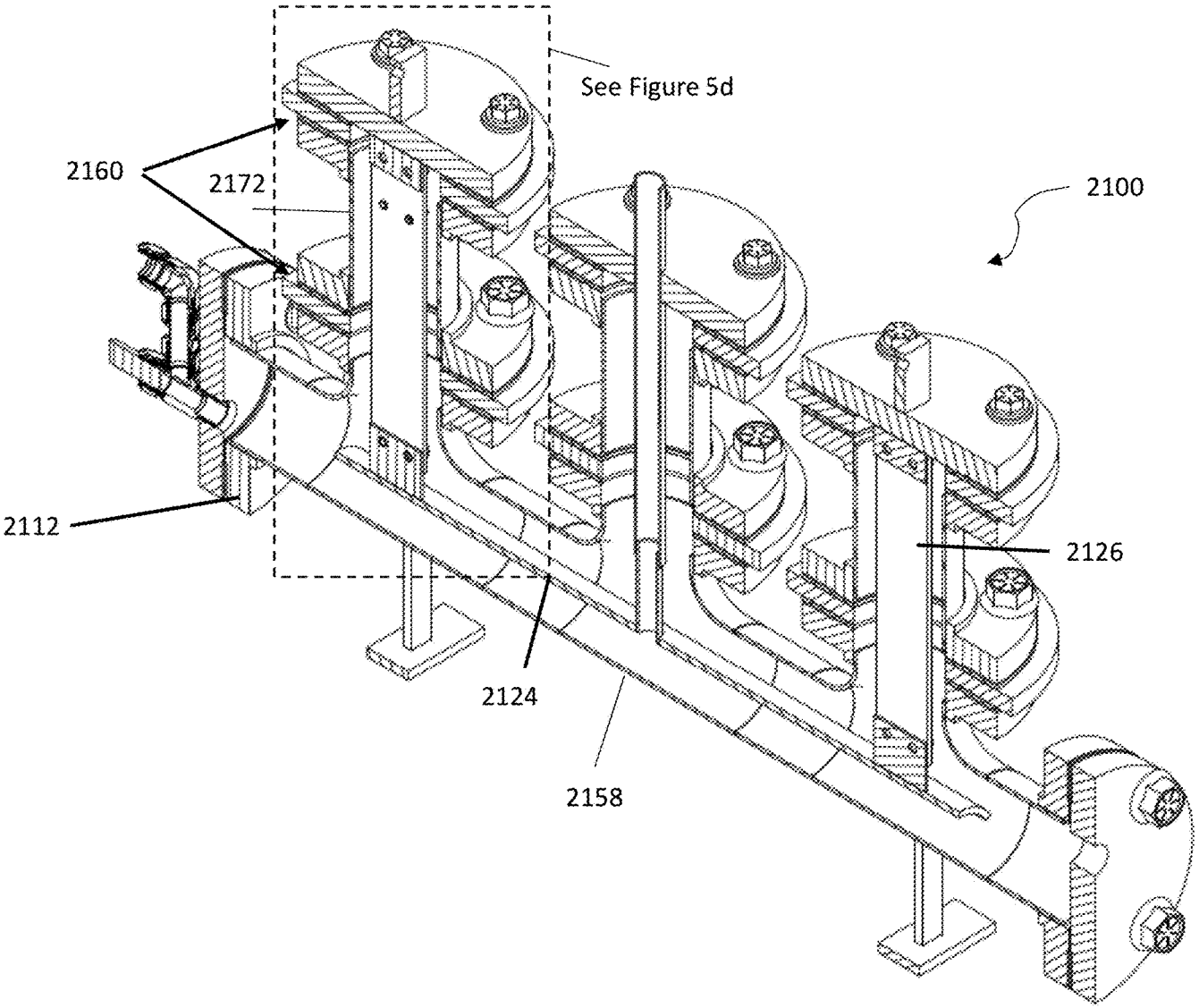
FIG. 5*c* is a perspective, cross-sectional view of a modified version of the electrorefining cell of FIG. 4.
Figure 5D:
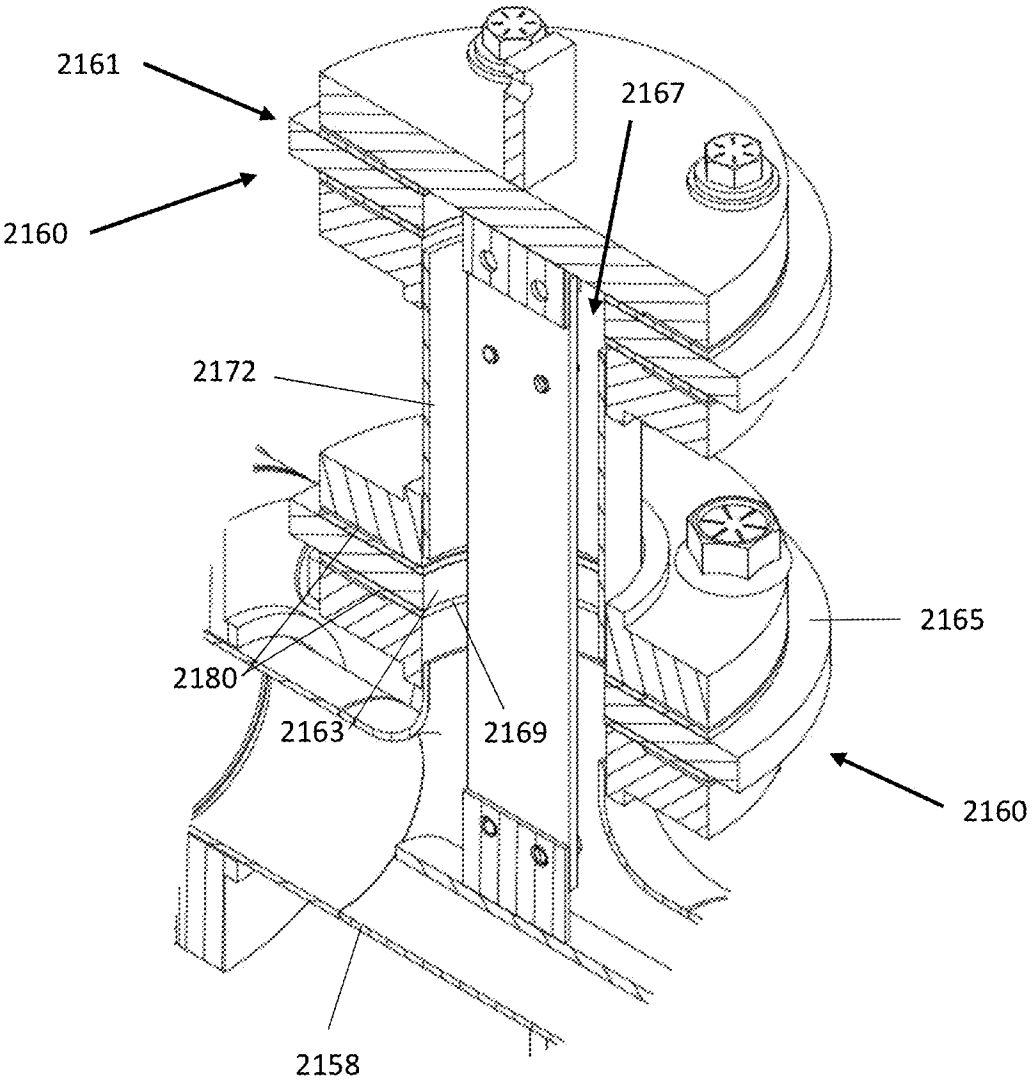
FIG. 5*d* is an enlarged view of a portion of the electrorefining cell of FIG. 13.
Figure 6:
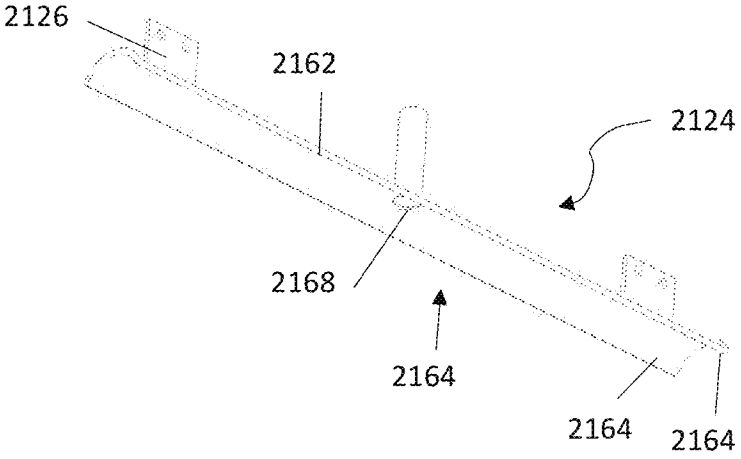
FIG. 6 is a perspective view of a portion of the electrorefining cell of FIG. 4.

Referring to FIGS. 4 to 6, another example of an electrorefining cell 2100 is illustrated. The cell 2100 is generally analogous to the cell 100 and like features are indicated using like reference characters indexed by 2000. In this example, the cell 2100 includes an anode layer 2102, having a respective feedstock inlet 2108 and feedstock outlet 2110, a refined metal layer 2106 and a layer of molten salt electrolyte 2104 positioned therebetween, with a respective electrolyte inlet 2132 and electrolyte outlet 2134. In FIG. 5*a* the layers 2102, 2104 and 2106 are identified using different cross-hatching that extends only part way across the cell 2100 so that the underlying structure is also visible in part of the drawing. This partial extension of the layers 2102, 2104 and 2106 is for illustrative clarity only, and in operation the layers 2102, 2104 and 2106 would extend the length of the housing 2112, between their respective inlets and outlets. The layers 2102, 2104 and 2106 are omitted from FIG. 5*b* for clarity.

In this example, instead of a separate member that is submerged within the anode layer the anode in the cell 2100 is provided by an portion 2158 of the housing 2112 that is connected to a power source via the connection and in electrical contact with the lithium-alloy material in the anode layer 2102, but that is electrically isolated from an upper portion of the housing 2172 that supports the cathode conducting member 2124 and can be at the same potential as the cathode in some examples. The isolated, anode conductor portion 2158 of the housing can be electrically isolated from the cathode conducting member 2124 using electrically insulating/isolating assemblies 2160 that include gaskets in the arrangement of FIGS. 4-5*b*, but could also include other mounting structures, such as sealing assemblies and isolating flanges (analogous to isolating flange 4180 described herein), insulators and other such features, or combinations of two or more such features.

Referring also to FIGS. 5*c* and 5*d*, an version of the apparatus 2100 is shown with a different style of isolating assembly 2160, that includes a layered structure including a sealing assembly and a pair isolating flanges. This arrangement can allow the use of a sealing assembly that may be electrically conductive, because it is sandwiched between a pair of electrically insulating isolating flanges. The apparatus 2100 has multiple isolating assemblies 2160 between different portions of the housing 2112. One isolating assemblies 2160 is described in detail below, and the other isolating assemblies 2160 may have an analogous configuration.

in the illustrated example, the isolating assemblies 2160 for the cell 2100 includes a seal assembly 2161 that can seal the connections between the lower portion 2158 of the housing 2112 and the upper portion(s) 2172 of the housing 2112 that can be at different electric potentials. In this example, the seal assembly 2161 is a generally self-healing, freeze seal in having a sealing face 2163 that is in contact with the interior of the cell 2100. Other types of seals may be considered in other embodiments of the present teachings.

In this example, the seal assembly 2161 includes a body 2165 that is shaped to match the fittings on the lower portion 2158 of the housing 2112, and has a central aperture 2167 that is sized receive other portions of the cell 2100. Preferably, the body 2165 is maintained at a seal temperature that is less than the freezing temperature of the electrolyte material using a suitable cooling system. In this example, the body 2165 is formed from a material with a relatively high thermal conductivity and is provided with an internal, fluid cooling conduit (not shown) through which a coolant fluid (such as water) can be circulated. This configuration can help ensure that substantially all of body 2165 will be at approximately the same seal temperature, including its outward facing surfaces that are likely to be in contact with the molten electrolyte. Suitable materials for the body 2165 may include copper, aluminum, steel and the like.

When the cell 2100 is in operation, electrolyte material can flow into contact with the surfaces of the body 2165 that face and are exposed to the interior of the chamber, such as surface 2163. With the body 2165 maintained at the seal temperature, molten catholyte material in contact with the body 2165 surfaces can solidify/freeze thereby forming a skin or protective layer of frozen electrolyte material. This protective layer can protect the body 2165 from exposure to the molten electrolyte and may also provide at least some degree of thermal and/or electrical insulation for the body (as the frozen electrolyte is not as conductive as the molten electrolyte). The protective layer may build up to a generally steady state thickness as the system is in use, where its inner surface is cooled by the body 2165 and its outer surface is generally at its melting point. The thickness may vary based on the operating conditions of the cell, but may be between about 0.5 mm and about 25 mm. The build-up of frozen electrolyte on the surface of the body 2165 can also extend to cover some adjacent structures to help protect them as well. In this example, isolating flanges 2180 are provided on either side of the body 2165. The isolating flanges 2180 are made from an electrically insulating material and are disposed between body 2165 and the lower portion 2158 of the housing sidewall, and between body 2165 and the upper portion 2172 of the housing sidewall. The isolating flange 2180 can be made from any suitable material, including a ceramic material, and can be configured and attached in a way that is analogous to how isolating flange 4180 is configured and attached. In the illustrated example, each wherein each isolating flange 2180 has an interior face 2169 that is exposed to the interior chamber and may be in contact with its contents. These interior faces 2169 are proximate the body 2165 and the sealing face 2163. Due to this proximity, the layer of frozen electrolyte that forms on the sealing face 2163 may extend beyond the face 2163 and cover at least a portion of the adjacent faces 2169 while the cell 2100 is in use, such that each interior face 2169 is at least partially covered with the layer of frozen electrolyte material, which may help protect the isolating flanges 2180.

The testing was conducted and demonstrated the application of a seal assembly that is an analogous to sealing assembly 2165 described herein, and includes a body or sealing freeze flange that can be operated at seal temperature that was lower than the freezing temperature of the flowing electrolyte materials used in the test. The freeze flange sealing assemblies were tested at a seal temperatures between 40 degrees Celsius and 60 degrees Celsius and this testing demonstrated that the assemblies do produce a layer of frozen electrolyte on the surface of the freeze flange as described herein.

This cell 2100 is configured as a generally elongate, conduit or pipe-like vessel, having a housing 2112 that extends along a cell axis 2170. This type of structure can help provide a relatively large surface area for the anode layer 2102 and other layers 2104 and 2106, while also being relatively easy to manufacture and to seal in a sufficiently air-tight manner (e.g. to help reduce contamination/reaction of the refined metal layer 2106).

This example also illustrates an alternative cathode configuration that may be used with cell 2100, and cell 100 and any other compatible cell arrangements. Referring also to FIG. 6, in this example the cathode conducting member 2124 is configured as a collection or hood type structure that is submerged within the cell 2100 and electrically connected to the power source using connections 2126. The hood defined by the cathode conducting member 2124 in this example is configured as a generally, curved conduit section with an open-bottom. Providing a curved profile may help facilitate extraction of the refined lithium metal as it may be less likely to get caught in the corners of the hood. This hood has an upper wall portion 2162 that is curved, and downwardly depending curved sidewall portions 2164 that define a lower opening 2166 that is configured to catch the molten, refined metal. An aperture 2168 is provided at a high point on the upper wall portion 2162 and is connectable to the inlet end of the refined metal extraction conduit 2128. When the cell 2100 is in use, refined metal collecting within the hood defined by the cathode conducting member 2124 can pass through the aperture 2168 in the cathode conducting member 2124 while being extracted. While a single aperture 2168 and single refined metal extraction conduit 2128 are shown in this example, other embodiments of the cathode conducting member 2124 may have more than one aperture 2164 and corresponding refined metal extraction conduit 2128.

Figure 13:
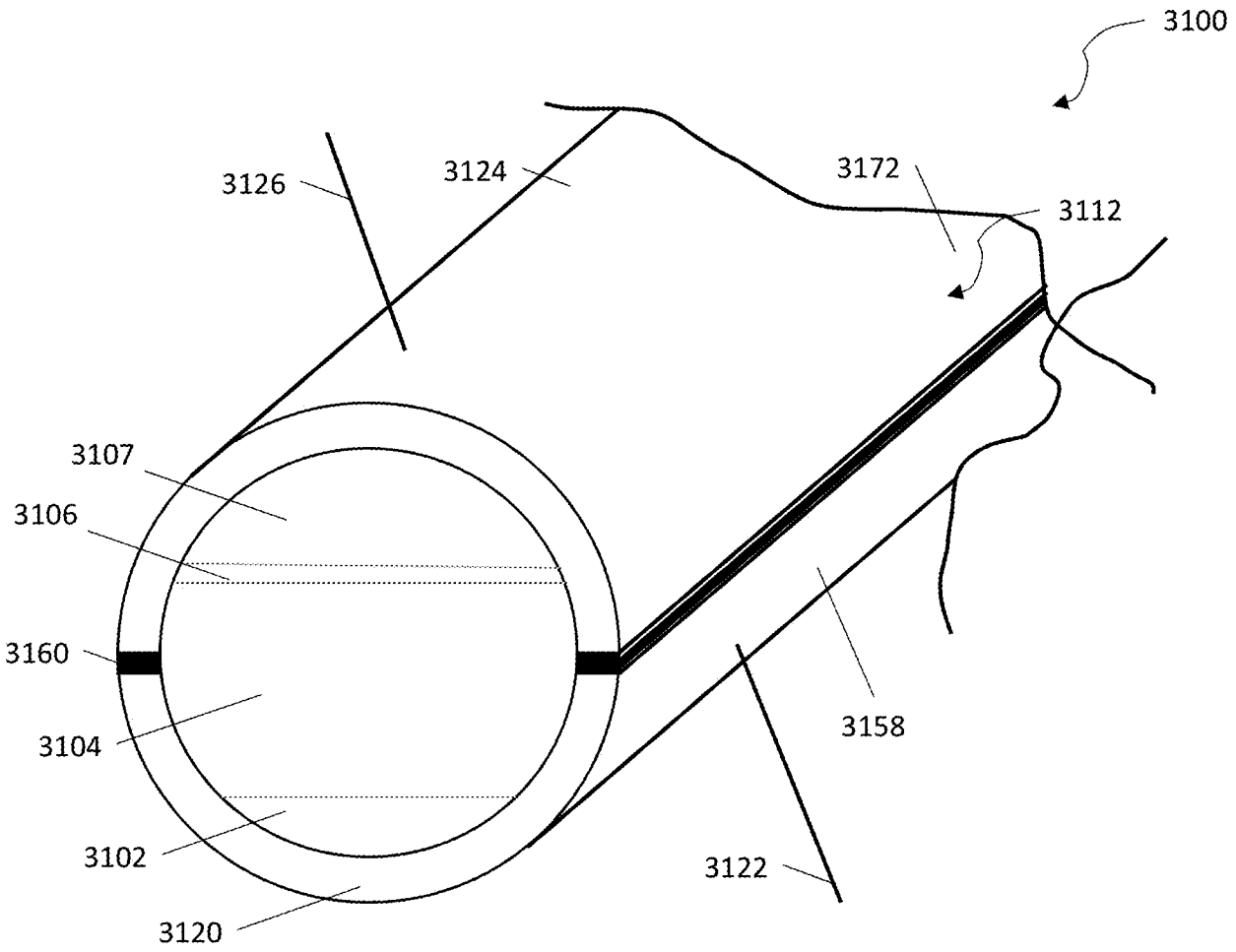
FIG. 13 is cross-sectional view of a schematic representation of another example of an electrorefining apparatus.

Referring to FIG. 13, portions of another schematic example of a cell 3100 are illustrated, with other portions being omitted for clarity. Cell 3100 is analogous to cell 100 and like features are labelled using like reference characters indexed by 3000. In this example, a housing 3112 is configured as an elongate, pipe-like housing and contains the anode layer 3102, electrolyte layer 3104 and refined metal, product layer 3106 and a cover gas headspace 3107. In this example, the anode conductor member 3120 is provided by a portion 3158 of the housing 3112 and the cathode conducting member 3124 is provided by an upper portion 3172 of the housing 3112, which is electrically isolated from the a suitable isolating assembly 3160, that can be a gasket, ceramic isolating flange or other suitable member. This may help simply construction of the cell 3100 and/or may help reduce its overall size and complexity, as compared to cells where the cathode is a separate member. The cell 3100 may be configured as a flow-through cell (having appropriate inlets and outlets) or as a static or batch cell.

Figure 8A:
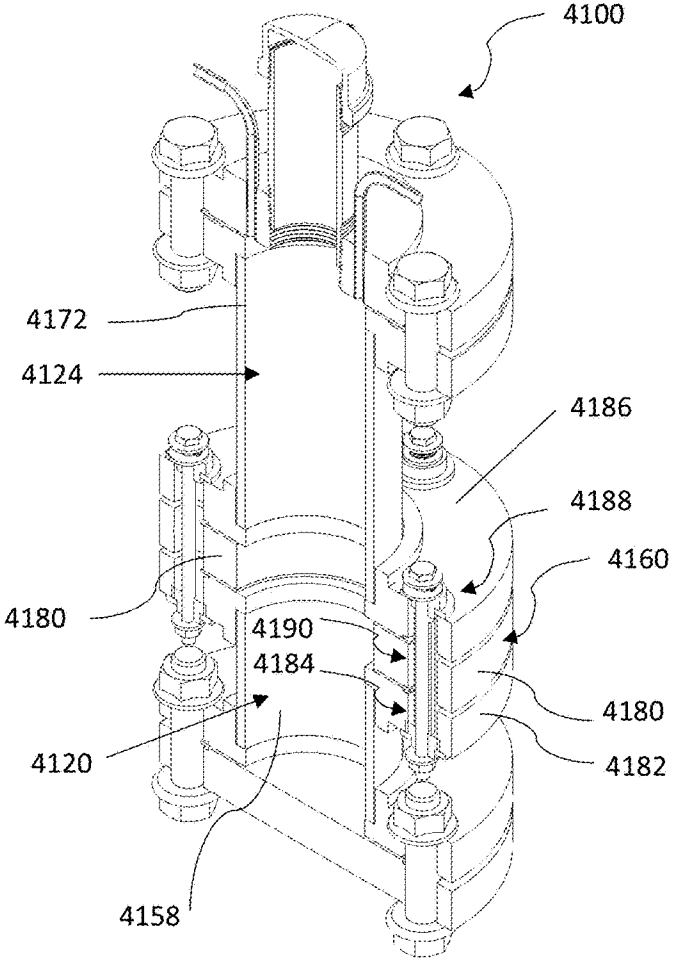
FIG. 8*a* is a side cross-sectional view of the electrorefining cell of FIG. 7, taken along line 8-8.
Figure 7:
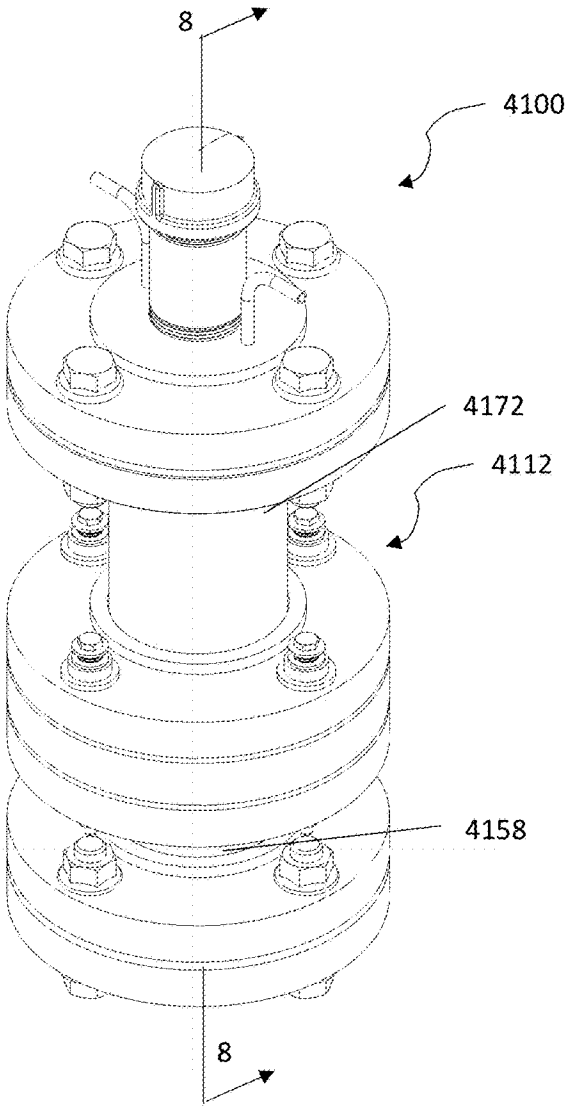
FIG. 7 is a perspective view of another example of an electrorefining cell.
Figure 8B:
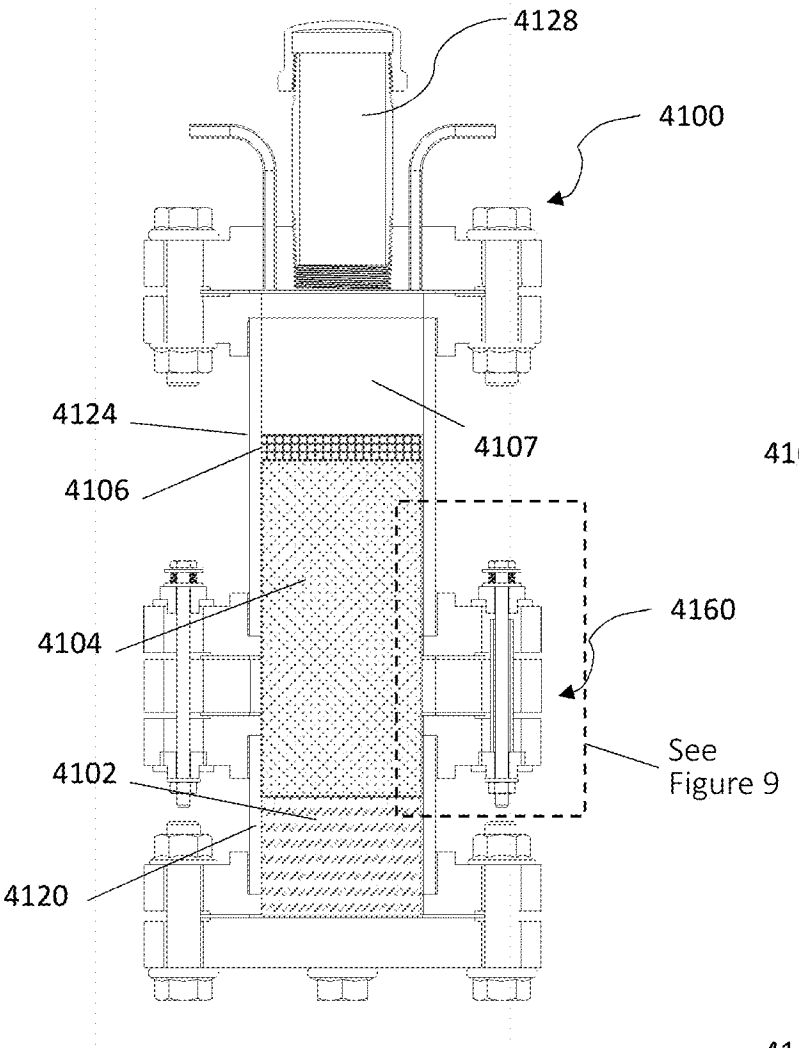
FIG. 8*b* is a perspective cross-sectional view of the electrorefining cell of FIG. 7, taken along line 8-8.

Referring to FIGS. 7-9, another example of an electrorefining cell 4100 is illustrated. Cell 4100 is analogous to cell 100 and like features are labelled using like reference characters indexed by 4000. In this example, the cell 4100 includes a housing 4112 that defines an interior chamber that contains an anode layer 4102, a refined metal, product layer 4106 and a layer of molten salt electrolyte layer 4104 positioned therebetween. A cover gas headspace 4107 is contained above the product layer 4106. This cell 4100 is configured as a static cell, and does not have feedstock or electrolyte inlets and outlets as illustrated in this example (but such inlets and outlets could be provided). In FIG. 10*ba* the layers 4102, 4104 and 4106 are identified using different cross-hatching. The layers 4102, 4104 and 4106 are omitted from FIGS. 8*a* and 9 for clarity.

In this example, a housing 4112 is configured as a generally vertical, pipe-like housing that includes an upper portion 4172 of the housing sidewall and a lower portion 4158 of the housing sidewall that are formed from different pieces and are joined together as described herein. In use the upper portion 4172 and the lower portion 4158 co-operate to help define a common interior chamber of the cell 4100 and are electrically isolated from each other such that they can be at different electric potentials when the cell 4100 is in use. Electrically isolating the sidewall portions 4172 and 4158 allows these sidewall portions to function as the cathode conducting member 4124 and anode conductor member 4120 respectively, when the sidewall portions 4172 and 4158 are connected to a suitable power source (not shown in these figures). This may help simply construction of the cell 4100 and/or may help reduce its overall size and complexity.

In this example, the sidewall portions 4172 and 4158 (and therefor the anode conductor member 4120 and cathode conducting member 4124) are electrically isolated from each other by an isolating assembly 4160. The isolating assembly 4160 is located between and electrically isolates the lower portion 4158 of the housing sidewall from the upper portion 4158 of the housing sidewall. Preferably, the isolating assembly can also and fluidly seal the sidewall portions 4158 and 4172 to inhibit leakage of the molten materials within the chamber.

In this example, the isolating assembly 4160 includes comprises an isolating flange 4180 made from an electrically insulating material that is disposed between the lower portion 4158 of the housing sidewall from the upper portion 4172 of the housing sidewall and is exposed to at least the electrolyte layer 4104. The isolating flange 4180 can be made from any suitable material, including a ceramic material.

The isolating flange 4180 can be attached to the housing portions 4158 and 4172 in any suitable manner that provides the desired mechanical connection, and preferably also provides fluid sealing. In the illustrated example, the lower portion 4158 of the housing sidewall includes a lower mounting lip 4182 that extends laterally outwardly from the sidewall and forms a generally annular or ring-like flange at the upper end of the lower portion 4158. The mounting lip 4182 includes a plurality of through-holes that function as a lower fastening apertures 4184 that are sized and configured to receive suitable, and preferably removable fasteners as described herein. The mounting lip 4182 may be integrally formed with the axially extending sidewall portion 4158, or may be made of a separate piece that his joined to the sidewall portion 4158.

Similarly, the upper portion 4172 of the housing sidewall includes an upper mounting lip 4186 that extends laterally outwardly from the sidewall and forms a generally annular or ring-like flange at the lower end of the upper portion 4172. The mounting lip 4186 includes a plurality of through-holes that function as a upper fastening apertures 4188 that are sized and configured to receive suitable, and preferably removable fasteners as described herein. The mounting lip 4186 may be integrally formed with the axially extending sidewall portion 4172, or may be made of a separate piece that his joined to the sidewall portion 4172. As shown herein, the upper apertures 4188 are registered above respective ones of the lower apertures 4184.

In this arrangement, the isolating flange 4180 also includes a plurality of holes that function as a flange fastening apertures 4190 that aligned with and registered between the with the lower and upper fastening apertures 4184 and 4188 so that a bolt or other fastener can extend through the apertures 4184, 4188 and 4190.

While any suitable fastener may be used, to help provide the desired electrical isolation between the wall portions 4158 and 4172, preferably the fastener that is used in the isolating assembly 4160 includes an electrically isolating fastener extending through the lower, flange and upper fastening apertures 4184, 4190 and 4188 to join the lower portion 4158 and the upper portion 4172 of the housing sidewall. In the illustrated example, wherein an isolating fastener 4192 includes an electrically insulating sleeve 4194 extending between the lower fastening aperture 4184 and the upper fastening aperture 4188 and receiving an electrically conductive bolt 4196 having a head 4198 adjacent one of the upper mounting lip or lower mounting lip (the upper lip 4186 in this example) and an electrically conductive nut 4200 threaded onto the bolt 4196 and adjacent the other of the upper mounting lip or lower mounting lip (the lower in this example) and at an opposing second end of the bolt 4196. To help isolate the electrically conductive bolt 4196 and nut 4200 from the mounting lips 4182 and 4186, the isolating assembly 4160 can include electrically isolating spacers/washers, such as electrically isolating spacers 4202 compressed between the head 4198 and the upper mounting lip 4186 and electrically isolating spacer 4204 compressed between the nut 4200 and the lower mounting lip 4182. Optionally, at least one of the insulating sleeve 4194, the electrically isolating spacers 4202 and electrically isolating spacers 4204 is formed from the same material as the isolating flange 4180.

Optionally, the isolating assembly 4160 can also include additional sealing and isolating gaskets 4206 can be included between the flange 4180 and mounting lips 4182 and 4186 to help enhance the performance of the isolating assembly 4160. These gaskets can be made from any suitable material, including vermiculite, mica and the like.

In this example, when the refined lithium metal is collected in the product layer 4106 it can be periodically extracted via a refined metal extraction conduit 4128, or by removing the top cover of the housing 4112.

Figure 12:
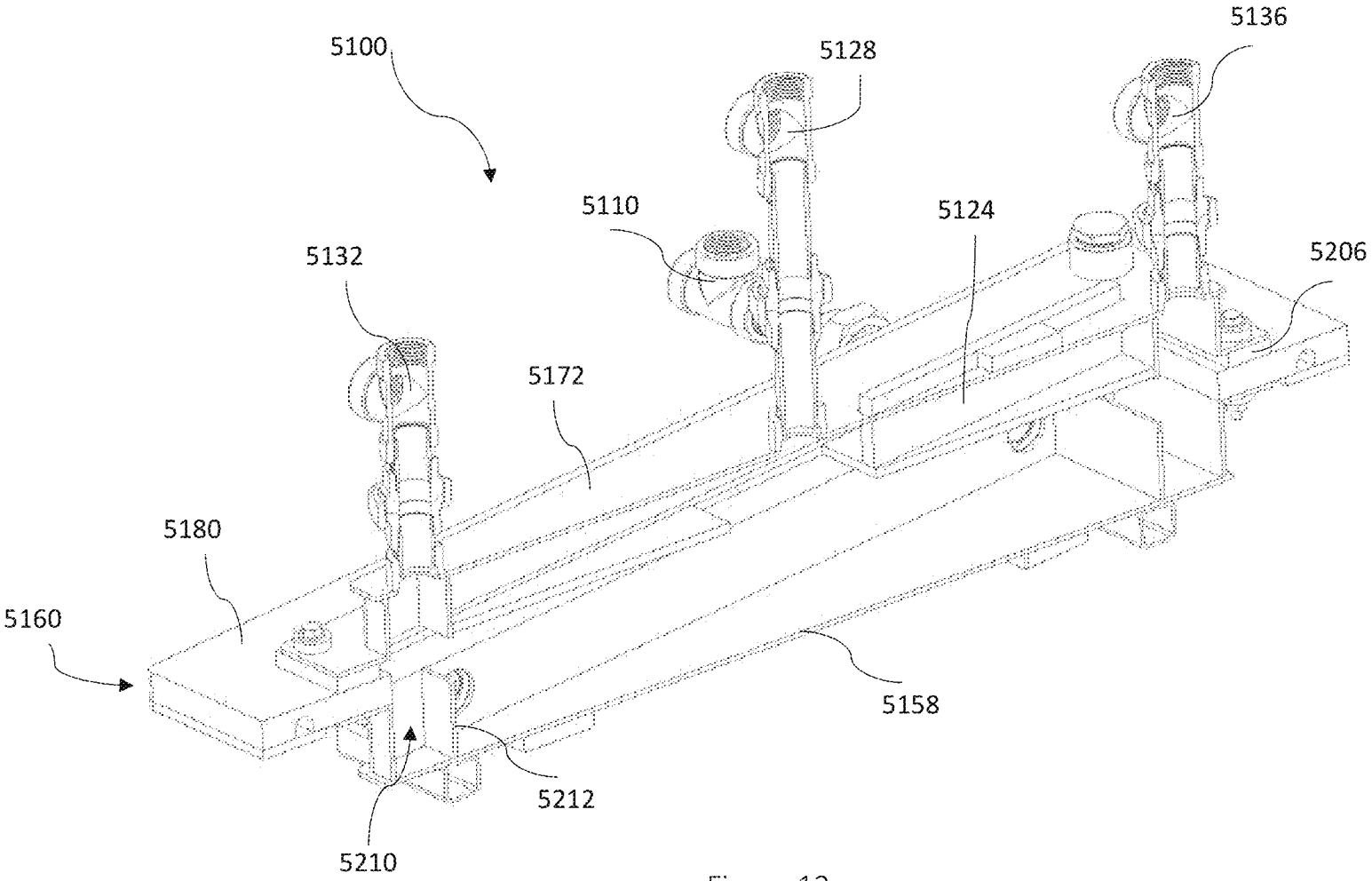
FIG. 12 is a side cross-sectional view of the electrorefining cell of FIG. 10, taken along line 12-12.

Referring to FIGS. 10-12, another example of an electrorefining cell 5100 is illustrated. The cell 5100 is generally analogous to the cell 100 and like features are indicated using like reference characters indexed by 5000. In this example, the cell 5100 includes an anode layer 5102, having a respective feedstock inlet 5108 and feedstock outlet 5110, a refined metal layer 5106 and a layer of molten salt electrolyte 5104 positioned therebetween, with a respective electrolyte inlet 5132 and electrolyte outlet 5134. In FIG. 11 the layers 5102, 5104 and 5106 are identified using different cross-hatching that extends only part way across the cell 5100 so that the underlying structure is also visible in part of the drawing. This partial extension of the layers 5102, 5104 and 5106 is for illustrative clarity only, and in operation the layers 5102, 5104 and 5106 would extend the length of the housing 5112, between their respective inlets and outlets. The layers 5102, 5104 and 5106 are omitted from FIG. 12 for clarity.

In this example, instead of a separate member that is submerged within the anode layer the anode in the cell 5100 is provided by an portion 5158 of the housing 5112 that is connected to a power source via the connection and in electrical contact with the lithium-alloy material in the anode layer 5102, but that is electrically isolated from the cathode conducting member 5124. The isolated, anode portion 5158 of the housing can be electrically isolated from the cathode conducting member 5124 using electrically insulating/isolating assemblies 5160, having an isolating flange 5180 and including gaskets 5206, but could also include other mounting structures, such as insulators. The fasteners used in cell 5100 can be analogous to the isolating fasteners described in relation to cell 4100, and the isolating assembly 5160 may be generally analogous to the assembly 4160.

This cell 5100 is configured as a generally elongate, conduit-like vessel that is generally rectangular rather than round, having a housing 5112 that extends along a cell axis 5170. This type of structure can help provide a relatively large surface area for the anode layer 5102 and other layers 5104 and 5106, while also being relatively easy to manufacture and to seal in a sufficiently air-tight manner (e.g. to help reduce contamination/reaction of the refined metal layer 5106).

In this example, the cell 5100 includes cathode conducting member s 5124 that can be connected to a suitable power source using connectors 5126, but that are also in electrical contact with the upper portion 5172 of the housing 5112, such that the upper portion 5172 and cathode conducting member s 5124 are all at the cathode potential when the cell 5100 is in use. An aperture 5168 is provided at a high point on housing 5112 and is connectable to the inlet end of the refined metal extraction conduit 5128. When the cell 5100 is in use, refined metal collecting within the product layer 5106 can pass through the aperture 5168 while being extracted. While a single aperture 5168 and single refined metal extraction conduit 5128 are shown in this example, other embodiments may have more than one aperture and corresponding refined metal extraction conduit.

Optionally, to help smooth the flow of the electrolyte material entering the interior chamber of the cell 5100, the cell 5100 may include an electrolyte settling chamber that is disposed within the housing 5112 between the electrolyte inlet 5132 and the electrolyte layer 5104. In this example, a region of the cell 5100 that is proximate and below the electrolyte inlet 5132 can function as an electrolyte settling chamber 5210. This electrolyte settling chamber 5210 is bounded by a portion of the housing sidewall and an internal weir 5212 that separates the electrolyte settling chamber 5210 from the anode layer 5102. Electrolyte material flowing in via inlet 5132 can first enter the electrolyte settling chamber 5210 where it can mix with electrolyte material that is already in the electrolyte settling chamber 5210, and material that reaches the top of the weir 5212 can then flow into the electrolyte layer 5104. In this example, the electrolyte settling chamber 5210 receives and temporarily contains the incoming electrolyte material, so that the electrolyte material exiting the electrolyte settling chamber 5210 by flowing over the weir 5212 is less turbulent than the electrolyte material entering the electrolyte settling chamber 5210 from the inlet 5132.

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. It is therefore contemplated that the appended claims will cover any such modifications or embodiments.

All publications, patents and patent applications referred to herein are incorporated by reference in their entirety to the same extent as if each individual publication, patent, or patent application was specifically and individually indicated to be incorporated by reference in its entirety.

I claim:

1. A three-layer electrorefining apparatus for refining relatively purer lithium metal from a lithium-alloy feedstock material, the apparatus comprising:

a housing defining an interior chamber at least partially bounded by a housing sidewall and containing;

an anode layer comprising a molten, lithium-alloy feedstock material that includes a combination lithium metal having a first purity and a carrier material that includes at least two of bismuth, indium, and tin;

an electrolyte layer above the anode layer and comprising a molten salt electrolyte material; and a product layer above the electrolyte layer comprising molten lithium metal having a second purity that is greater than the first purity;

an anode conductor member connectable to a power source and in contact with the lithium-alloy feedstock material in the anode layer;

a cathode conductor member connectable to the power source, electrically isolated from the anode conductor member and in contact with the lithium metal in the product layer;

a molten salt electrolyte inlet at a first end of the housing for introducing a flow of the molten salt electrolyte material into the interior chamber during operation; and a molten salt electrolyte outlet at a second end of the housing for allowing the molten salt electrolyte material to be withdrawn from the interior chamber during operation, the second end being spaced from the first end, whereby, when an activation electric potential that is sufficient to electrolyze the lithium-alloy feedstock material is applied between the anode layer and the product layer lithium metal is liberated from the lithium-alloy feedstock material, migrates through the electrolyte layer and collects in the product layer.

2. The apparatus of claim 1, wherein the carrier material includes bismuth, indium and tin.

3. The apparatus of claim 2, wherein the carrier material includes about 30 wt % to about 60 wt % bismuth; about 22 wt % to about 60 wt % indium; and about 10 wt. % to about 60 wt. % tin.

4. The apparatus of claim 2, wherein the electrolyte material comprises a eutectic; wherein the eutectic includes LiCl—KCl, LiI—KI, LiI—CsI, or a mixture thereof.

5. The apparatus of claim 1, wherein the electrolyte material comprises a eutectic; wherein the eutectic includes LiCl—KCl, LiI—KI, LiI—CsI, or a mixture thereof.

6. The apparatus of claim 5, wherein the eutectic includes an admixture of a eutectic mixture of LiCl—KCl, a eutectic mixture of LiI—KI, and a eutectic mixture of LiI—CsI.

7. An electrorefining process for refining relatively purer lithium metal from a lithium-alloy feedstock material using a three-layer electrorefining apparatus having a housing defining an interior chamber, the process comprising:

providing an anode layer comprising a molten, lithium-alloy feedstock material that includes a combination lithium metal having a first purity and a carrier material that includes at least two of bismuth, indium, and tin;

providing an electrolyte layer comprising a molten salt electrolyte material above the anode layer and within the interior chamber;

providing a product layer comprising molten lithium metal having a second purity that is greater than the first purity above the electrolyte layer within the interior chamber;

applying an activation electric potential that is sufficient to electrolyze the lithium-alloy feedstock material between the anode layer comprising the lithium-alloy feedstock material and the product layer that is electrically isolated from the anode layer, whereby lithium metal is separated from the lithium-alloy feedstock material, migrates through the electrolyte layer and collects in the product layer; and concurrently with said applying introducing a flow of the molten salt electrolyte material at a molten salt electrolyte inlet at a first end of the interior chamber; and extracting the molten salt electrolyte material through a molten salt electrolyte outlet at a second end of the interior chamber, the second end being spaced from the first end.

8. The process of claim 7, further comprising, concurrently with said applying, introducing a flow of the lithium-alloy feedstock material into the interior chamber via a feedstock inlet in communication with the anode layer, conveying the lithium-alloy feedstock material through the interior chamber in a first flow direction and extracting a flow of the lithium-alloy feedstock material from the interior chamber via a feedstock outlet, wherein the lithium-alloy feedstock material entering via the feedstock inlet contains more lithium metal than the lithium-alloy feedstock material extracted via the feedstock outlet.

9. The process of claim 8 further comprising conveying the molten salt electrolyte material through the interior chamber in the first flow direction.

10. The process of claim 9 further comprising inhibiting mixing between the anode layer and the electrolyte layer by conveying the lithium-alloy feedstock material through the interior chamber as a substantially laminar flow and conveying the molten salt electrolyte material through the interior chamber as a substantially laminar flow.

* * * * *